US005895592A

United States Patent [19]

Struble et al.

[11] Patent Number: 5,895,592

[45] Date of Patent: Apr. 20, 1999

[54] APPARATUS AND METHOD FOR THERMALLY PROCESSING AN IMAGING MATERIAL EMPLOYING A SYSTEM FOR REDUCING FOGGING ON THE IMAGING MATERIAL DURING THERMAL PROCESSING

[75] Inventors: Kent R. Struble, Woodbury; David J. McDaniel, Cottage Grove, both of Minn.

[73] Assignee: Imation Corp., Oakdale, Minn.

[21] Appl. No.: 08/922,278

[22] Filed: Sep. 3, 1997

Related U.S. Application Data

[63] Continuation-in-part of application No. 08/769,430, Dec. 19, 1996.

[51] Int. Cl.[6] ..... G03G 15/28; G03D 7/00

[52] U.S. Cl. ..... 219/216; 399/92; 396/579

[58] Field of Search ..... 219/216, 467–471; 399/92, 93, 327–380, 335–338; 34/79, 82, 90, 638, 639; 396/579

[56] References Cited

U.S. PATENT DOCUMENTS

| | | | |
|---|---|---|---|
| 3,570,383 | 3/1971 | Berg | 95/89 |
| 3,629,549 | 12/1971 | Svendsen | 219/216 |
| 3,648,019 | 3/1972 | Brewitz | 219/386 |
| 3,709,472 | 1/1973 | Kreitz et al. | 263/6 E |
| 3,727,534 | 4/1973 | Low, Jr. et al. | 95/89 R |
| 3,739,143 | 6/1973 | Amundson et al. | 219/216 |
| 3,774,520 | 11/1973 | Smith et al. | 95/89 R |
| 3,798,790 | 3/1974 | Roman | 34/155 |
| 4,056,824 | 11/1977 | Iiyama et al. | 396/579 |
| 4,076,532 | 2/1978 | Gottermeier | 96/48 HD |
| 4,242,566 | 12/1980 | Scribner | 219/216 |
| 4,255,037 | 3/1981 | Meadows et al. | 354/299 |
| 4,313,666 | 2/1982 | Koblo et al. | 354/299 |
| 4,377,331 | 3/1983 | Seelenbinder et al. | 354/300 |
| 4,473,282 | 9/1984 | Michlin | 354/300 |
| 4,518,845 | 5/1985 | Svendsen | 219/216 |
| 4,644,667 | 2/1987 | Yanagi et al. | 34/54 |
| 4,668,073 | 5/1987 | Hatabe et al. | 219/216 |
| 4,890,136 | 12/1989 | Greene et al. | 355/27 |
| 5,038,174 | 8/1991 | Kato et al. | 399/92 |
| 5,068,684 | 11/1991 | Abe et al. | 355/27 |
| 5,081,496 | 1/1992 | Takeda | 399/92 |
| 5,097,605 | 3/1992 | Kashino et al. | 34/18 |
| 5,352,863 | 10/1994 | Svendsen | 219/388 |
| 5,469,238 | 11/1995 | Biegler | 354/300 |
| 5,510,871 | 4/1996 | Biegler et al. | 354/300 |
| 5,563,681 | 10/1996 | Kirkwold et al. | 355/30 |
| 5,600,396 | 2/1997 | Biegler et al. | 396/565 |

FOREIGN PATENT DOCUMENTS

| | | |
|---|---|---|
| 0 679 946 A1 | 11/1995 | European Pat. Off. . |
| 0 679 947 A1 | 11/1995 | European Pat. Off. . |
| 7-36170 | 2/1995 | Japan . |

*Primary Examiner*—Teresa Walberg
*Assistant Examiner*—J. Pelham
*Attorney, Agent, or Firm*—Dicke, Billig & Czaja, P.A.

[57] ABSTRACT

A thermal processor and method for using the same which is particularly useful for developing a sheet of imaging material, such as photothermographic film. The thermal processor includes means for transporting the imaging material through the apparatus. The thermal processor also includes means for heating the imaging material to develop the image in the imaging material. The thermal processor also includes a fog reduction system which removes a gaseous by-product emitted from the imaging material which may cause fogging of the image as the image is developed on the imaging material.

22 Claims, 21 Drawing Sheets

APPARATUS AND METHOD FOR THERMALLY PROCESSING AN IMAGING MATERIAL EMPLOYING A SYSTEM FOR REDUCING FOGGING ON THE IMAGING MATERIAL DURING THERMAL PROCESSING

CROSS REFERENCES TO CO-PENDING APPLICATIONS

This application is a continuation-in-part of U.S. Ser. No. 08/769,430, filed Dec. 19, 1996, entitled "Apparatus and Method for Thermally Processing an Imaging Material Employing Means for Reducing Fogging on the Imaging Material During Thermal Processing" to the same assignee as the present application.

TECHNICAL FIELD

The present invention relates generally to an apparatus and method for thermal processing a material and more specifically an apparatus and method for thermally developing an imaging material, including an apparatus and method for removing/reducing a gaseous by-product which may cause fogging of the thermally processable material, thereby reducing or eliminating fogging of an image during development of the image in the thermally processable material as it is transported through the thermal processor.

BACKGROUND OF THE INVENTION

The present invention is a method and apparatus for developing sheets of light sensitive photothermographic or heat developable film. Light sensitive photothermographic film typically includes a thin polymer or paper base coated with an emulsion of dry silver or other heat sensitive material. Once the film has been subjected to photostimulation by optical means, such as laser light, it is developed through the application of heat.

Heat development of light sensitive heat developable sheet material has been disclosed in many applications ranging from photocopying apparatus to image recording/printing systems. The uniform transfer of thermal energy to the heat developable material is critical in producing a high quality printed results. The transfer of thermal energy to the film material should be conducted in a manner that will not cause introduction of artifacts. These artifacts may be physical artifacts, such as surface scratches, shrinkage, curl, and wrinkle, or developmental artifacts, such as non-uniform density and streaks. Numerous attempts to overcome the above mentioned artifacts have resulted in limited success.

The U.S. Pat. No. 4,242,566 describes a heat-pressure fusing apparatus that purports to exhibit high thermal efficiency. This fusing apparatus comprises at least one pair of first and second oppositely driven pressure fixing feed rollers, each of the rollers having an outer layer of thermal insulating material. First and second idler rollers are also included. A first flexible endless belt is disposed about the second idler roller and each of the first pressure feed rollers. A second flexible endless belt is disposed about the second idler roller and each of the second pressure feed rollers. At least one of the belts has an outer surface formed of a thermal conductive material. An area of contact exists between the first and second pressure feed rollers and allows the heat developable light sensitive sheet material to pass between two belts while under pressure. When an unfused (undeveloped) sheet of material is passed through the area of contact between two belts, the unfused sheet is subjected to sufficient heat pressure to fuse the development of the sheet of material. This apparatus, although useful for photocopying applications, will subject the sensitive material to excessive pressure. Excessive pressure can result in the formation of physical image artifacts, such as surface scratches and wrinkles, especially if the material is of polyester film construction.

In U.S. Pat. No. 3,739,143, a heat developer is described for developing light sensitive sheet material without imparting pressure to the sensitive coating while the sheet material is being heated. This developer includes a rotating drum cylinder and an electrically heated metal plate where it is partially covering the cylinder and spaced therefrom to define a space for the sheet material corresponding to the thickness of sheet material. The sheet material is guided through an opening to be wrapped around the rotating cylinder while heat is being applied by the metal plate partially covering the rotating cylinder. While this developer may satisfactorily develop paper-based heat-developable image, this developer is not well suited to develop polyester film base material having imprecise control of film heating and pressure application. In addition, the curled path can introduce curling artifacts when the polyester film material is used.

U.S. Pat. Nos. 3,629,549 and 4,518,845 both disclose developers having thermally insulating drums concentrically mounted within a heating member. Sheets of light sensitive material such as coated paper or coated polyester film are developed by being engaged by the drum and driven around the heating member. While the developers of this type may be suited well for paper coated light sensitive material, they tend to develop various artifacts in a polyester film with coated emulsion, such as scratches and nonuniform density development when the film sticks to the drum surface.

The development device disclosed in U.S. Pat. No. 3,709,472 uses a heated drum to develop strips of film. However, this device is not suitable for developing single sheets of film having soft coated emulsion layers.

U.S. Pat. No. 3,648,019 discloses another developer with a pair of heaters on opposite sides of a low thermal mass locating device, such as a screen assembly. Although portable, this developer is relatively slow and poorly suited for commercial applications.

Other photothermographic film developers include a heated drum which is electrostatically charged to hold the film thereon during development. Since the side of the film bearing the emulsion is not in contact with the drum or other developer components, it is not subject to sticking or scratching as in some of the developers discussed above. Unfortunately, the electrostatic system used to hold the film on the drum during development is relatively complicated and poorly suited for developers configured to develop larger sized sheets of film.

The U.S. Pat. No. 5,352,863 discloses a photothermographic film processor purported to be capable of quickly and uniformly developing large sheets of photothermographic film. This developer consists of an oven having a film entrance and exit; a generally flat and horizontally oriented bed of film support material mounted for movement within the oven along a film transport path between the film entrance and exit; and, a drive mechanism for driving the bed of material to transport the film through the oven along the path. The film support material, which is in the form of the padded rollers, is noted to have a sufficiently low thermal capacity to enable visible pattern-free development of the film as the film is transported through the oven.

Unfortunately, this apparatus is relatively large and has not fully addressed the need to manage the thermal expansion and contraction of the imaging material to prevent, for example, wrinkling, nor the need to minimize the effect of convective currents during the thermal development of the imaging material.

In general, and as it is discussed in the background sections of the patents referenced above, the density of the developed image is dependent upon the precise and uniform transfer of heat to the film emulsion. Nonuniform heating artifact can produce an unevenly developed image density. Uneven physical contact between the film and any supporting structures during development can produce visible marks and patterns on the film surface.

It is evident that a continuing need exists for improved photothermographic film developers. In particular, there is a need for a developer capable of quickly and uniformly developing large sheets of polyester, emulsion-coated film without introducing physical and developmental artifacts that are described above.

SUMMARY OF THE INVENTION

The present invention provides an apparatus and method which addresses problems not addressed by the prior art. One embodiment of the present invention includes a thermal processor useful for thermally developing an image in an imaging material. The imaging material has a material first surface and a material second surface. The thermal processor includes at least a first and second rotatable members positioned to contact the material first surface. The thermal processor also includes means for transporting the imaging material in a first direction toward the at least first and second rotatable members. At least a third rotatable member is positioned to contact the material second surface. The at least third rotatable member is positioned relative to the at least first and second rotatable members such that the imaging material is redirected at least twice when transported between the at least first and second lower rotatable members and the at least third rotatable member. The thermal processor also includes means for heating the imaging material when the imaging material is transported between the at least first and second rotatable members and the at least third rotatable member.

Another embodiment of the present invention includes a thermal processor useful for developing an image in an imaging material which is transported along a transport path through the thermal processor. The imaging material has a material upper surface and a material lower surface. The thermal processor includes means for heating the imaging material and means for transporting the imaging material in a first direction to the heating means. The thermal processor also includes means for bending the material a plurality of times to have a plurality of curvatures when the imaging material is heated by the heating means. Each curvature has a curvature axis which is generally perpendicular to the transport path.

Another embodiment of the present invention includes a method useful for thermally developing an image in an imaging material. The imaging material has a material first surface and a material second surface. The method includes providing at least a first and second rotatable members positioned to contact the material first surface. Another step includes transporting the imaging material in a first direction toward the at least first and second rotatable members. Another step is providing at least a third rotatable member positioned to contact the material second surface. The at least third rotatable member is positioned relative to the at least first and second rotatable members such that the imaging material is redirected at least twice when transported between the at least first and second lower rotatable members and the at least third rotatable member. Another step includes heating the imaging material when the imaging material is transported between the at least first and second rotatable members and the at least third rotatable member.

Another embodiment of the present invention includes a method useful for thermally developing an image in an imaging material. The method includes transporting the imaging material into a thermal processor along a transport path and initially in a first direction. The imaging material is at a first temperature when transported into the thermal processor. Another step is heating the imaging material within the thermal processor from the first temperature to a higher developing temperature range. Another step is redirecting the imaging material within the thermal processor such that the imaging material is transported in a second direction and such that the imaging material is bent and has a first curvature when the imaging material is being heated from the first temperature towards the higher developing temperature range. The first curvature has a first curvature axis which is generally perpendicular to the transport path. Another step is redirecting the imaging material within the thermal processor from the second direction such that the imaging material is transported in a third direction and such that the imaging material is bent a second time and has a second curvature when the imaging material is being heated from the first temperature towards the higher developing temperature range. The third direction is different from the second direction. The second curvature has a second curvature axis which is generally perpendicular to the transport path. Another step is transporting the imaging material out of the thermal processor.

Another embodiment of the present invention includes a thermal processor useful for thermally developing an image in an imaging material, the imaging material having a material first surface and a material second surface. The thermal processor includes means for heating the imaging material comprising a plurality of heated surfaces within the thermal processor. The thermal processor also includes means for transporting the imaging material through the thermal processor. The thermal processor also includes means for bending the imaging material a plurality of times to have a plurality of curvatures and for positioning the imaging material adjacent to the plurality of heated surfaces when the imaging material is heated by the heating means.

Another embodiment of the present invention includes a method useful for thermally developing an image in an imaging material. The imaging material has a material upper surface and a material lower surface. The method includes providing at least one heated surface within the thermal processor. Another step is transporting the imaging material through the thermal processor and adjacent to the heated surface to heat the imaging material. Another step is positioning the imaging material adjacent to the at least one heated surface by bending the imaging material a plurality of times when the imaging material is transported through the thermal processor.

Another embodiment of the present invention includes an apparatus for thermally developing an imaging in an imaging material. The apparatus includes means for transporting the imaging material through the apparatus. Means are provided for heating the imaging material to develop the image in the imaging material. The apparatus also includes means for reducing fogging of the imaging material as the image is developed on the imaging material. A gaseous by-product may be emitted from the imaging material as the image is developed in the imaging material. The apparatus may further include means for removing at least a portion of the gaseous by-product from the apparatus.

Another embodiment of the present invention includes a thermal processor for use in developing an image in an image material. The image material is transported along a transport path through the thermal processor. The thermal processor includes a dwell section where the image is developed in the imaging material. The thermal processor further includes a heated member located below the exchanging material. The thermal processor includes means for removing air from the surface of the imaging material through the heated member, as the image is developed in the imaging material. The means for exchanging air may further comprise an exhaust air passageway located in the heated member. An exhaust fan may be mechanically coupled to the exhaust air passageway. The thermal processor may further include means for providing makeup air to the location where the image is developing. The means for providing makeup air may include a makeup air passageway. The means for providing makeup air may further comprise means for heating the makeup air to a desired temperature.

Another embodiment of the present invention includes a method useful for thermally developing an image in an imaging material. The method includes transporting the imaging material through a thermal processor along a transport path. The imaging material is heated as it passes through the thermal processor from a first temperature to a higher developing temperature. The image is developed on the imaging material. Fog on the imaging material is reduced as the image is developed in the imaging material. The step of reducing the fog may include removing a fog producing gas by-product from the thermal processor. The fog producing gas by-product may be removed along the surface of the imaging material. The step of reducing the fog may further comprise the steps of providing an exhaust air passageway in the thermal processor and removing the fog producing gas by-product through the exhaust air passageway. The method may further include the step of providing a makeup air passageway for makeup air to enter the thermal processor. The makeup air may be heated to a temperature which is approximate the temperature of the imaging material. The makeup air may be passed across an imaging surface of the imaging material as the image is developed in the imaging material.

Another embodiment of the present invention provides a thermal processor for use in developing an image in an imaging material. The imaging material is transported along a transport path through the thermal processor. As the image is developed in the imaging material, a gaseous by-product is emitted from the imaging material which may tend to cause fogging of the developed image. The thermal processor comprises a preheat assembly for preheating the imaging material to a desired temperature, a dwell assembly for thermal development of the imaging material, and a cooling assembly for cooling the imaging material after development. A mechanism is provided which moves the imaging material along the transport path through the preheat assembly, the dwell assembly and the cooling assembly. The dwell assembly further includes a heated lower member having a major surface facing the imaging material, a lower member makeup air passageway extending through the major surface, and a lower member exhaust air passageway extending through the major surface. An exhaust mechanism is provided in communication with the lower member exhaust air passageway for removal of the gaseous by-product therethrough. Further, a makeup air mechanism may be provided in communication with the lower member makeup air passageway which provides makeup air through the lower member makeup air passageway. The makeup air mechanism includes a fresh air supply fan. The exhaust air mechanism includes an exhaust fan.

The exhaust air passageway extends longitudinally through the lower member in a direction generally perpendicular to the direction of movement of the film, and includes an exhaust port opening extending through the major surface. The makeup air passageway extends longitudinally through the lower member in a direction generally perpendicular to the direction of movement of the film, and includes a makeup air port opening extending through the major surface.

The major surface includes a curved portion extending generally longitudinally across the lower portion in a direction generally perpendicular to direction of movement of the film and a thin portion. The mechanism which moves the imaging material includes a roller which nests within the curved portion, and wherein the imaging material includes an emulsion surface which contacts the surface of the roller. The exhaust air passageway includes an exhaust air chamber extending longitudinally through the lower member in a direction generally perpendicular to the direction of movement of the film, having an exhaust port extending through the major surface. The makeup air passageway includes a makeup air chamber extending longitudinally through the lower member generally parallel to the exhaust air passageway, having a makeup air port extending through the major surface. The exhaust air chamber may be positioned adjacent the thin portion, and the makeup air chamber may be positioned adjacent the curved portion. The exhaust air port extends through the thin portion, and the makeup air port extends through the curved portion. The makeup air chamber may include a first end and a second end, wherein the makeup air mechanism is coupled to the exhaust air passageway proximate the first end, and wherein the makeup air port is in communication with the makeup air chamber proximate the second end, allowing the makeup air to be heated to a temperature which is approximate the temperature of the lower member. In one application, the thin portion is generally trapezoidal shaped, having its widest major surface adjacent the imaging material. A thin extension member may be provided extending longitudinally along the thin portion, wherein the thin extension member is generally trapezoidal shaped, having a first major surface and a second major surface wider than the first major surface, wherein the second major surface is positioned adjacent the imaging material.

In another embodiment, the present invention includes a thermal processor for use in developing an image on a thermal photographic material which is transported along a transport path through the thermal processor. As the image is developed in the thermal photographic material, a gaseous by-product is emitted from the imaging material which may tend to cause fogging of the developed image. The thermal processor includes a development chamber defined by a heated upper member and a heated lower member. A mechanism is provided for moving the thermal photographic material through the development chamber along the transport path, including a plurality of rollers movably mounted within the development chamber extending longitudinally across the development chamber in a direction generally perpendicular to the direction of movement of the thermal photographic material. Each roller includes a roller surface which contacts the thermal photographic material. The heated lower member includes a first major surface and a second major surface. The first major surface includes a plurality of curved portions and a plurality of thin portions, wherein each roller nests within a corresponding curved portion, and wherein each fin is defined by adjacent curved portions. A fog reduction system is provided for removal of the gaseous by-product emitted from the thermal photographic material before it causes fogging. The fog reduction system includes an exhaust chamber extending longitudinally through the lower member, having an exhaust port extending through the thin portion at a location adjacent the thermal photographic material; a makeup air chamber extending longitudinally the lower member, having a makeup air port extending through the curved portion adjacent a roller; and a makeup air mechanism in communication with the makeup air chamber, which provides fresh makeup air through the makeup air port.

The makeup air chamber extends longitudinally through the lower member in a direction generally perpendicular to the direction of movement of the thermal photographic material. The makeup air chamber includes a first end and a second end, wherein the makeup air mechanism is in communication with the makeup air chamber at a location proximate the first end, and wherein the makeup air port extends from the makeup air chamber at a location proximate the second end, allowing the makeup air to heat up to a temperature which is approximate the temperature of the lower member. A second makeup air port may extend from the makeup air chamber through the curved portion, located proximate the second end.

A second makeup air chamber may extend through the lower member located adjacent the first makeup air chamber, having a makeup air port extending through the curved portion and including a first end and a second end, wherein the makeup air port is in communication with the second makeup air chamber at a location proximate the second end, and wherein the makeup air port extends from the second makeup chamber at a location proximate the first end. The first makeup air chamber first end is positioned adjacent the second makeup air chamber first end. An exhaust mechanism is in communication with the exhaust air chamber for removal of the gaseous by-product therethrough. In one application, the thin portion is generally trapezoidal shaped, having its widest major surface adjacent the thermal photographic material. Alternatively, a thin extension member is provided extending longitudinally along the thin portion positioned adjacent the thermal photographic material. The thin extension member is generally trapezoidal shaped, having a first major surface and a second major surface wider than the first major surface, wherein the second major surface is positioned adjacent the thermal photographic material.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
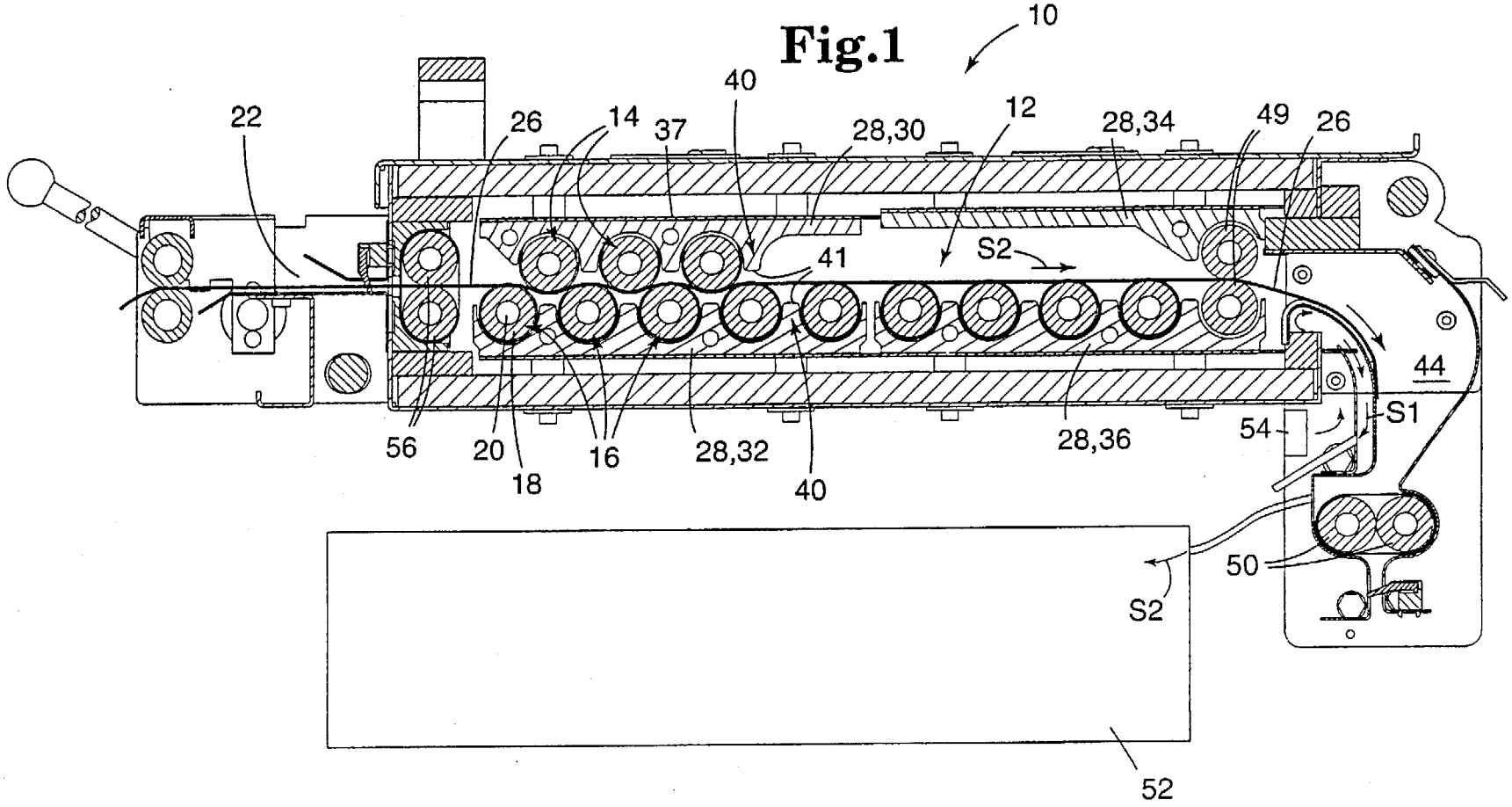
FIG. 1 is a side sectional view of one embodiment of a thermal processor in accordance with the present invention.

A thermal processor 10 in accordance with the present invention is illustrated in FIGS. 1–4 and 6. The thermal processor 10 can include a heated enclosure or oven 12 and a number of upper rollers 14 and lower rollers 16 therein.

Rollers 14, 16 can include support rods 18 with cylindrical sleeves of a support material 20 surrounding the external surface of the rods 18. The rods 18 are rotatably mounted to the opposite sides of oven 12 to orient rollers 14, 16 in a spaced relationship about a transport path between an oven entrance 22 and oven exit 24. The rollers 14, 16 are positioned to contact a thermally processable material 26 (hereinafter TPM 26), such as a thermally processable imaging material. Examples of thermally processable imaging materials include thermographic or photothermographic film (a film having a photothermographic coating or emulsion on at least one side). The term "imaging material" includes any material in which an image can be captured, including medical imaging films, graphic arts films, imaging materials used for data storage, and the like.

One or more of the rollers 14, 16 can be driven in order to drive the TPM 26 through the oven 12 and adjacent to heated members 28. Preferably, all of the rollers 14, 16 that contact the TPM 26 are driven so that the surface of each roller is heated uniformly when no TPM 26 is contacting the rollers 14, 16. As a result, the surface is maintainable within a relatively tight temperature range.

The support material 20 can be a low thermal mass, low thermal conductivity material, such as foam, such that it retains and transfers relatively insubstantial amounts of heat with respect to that generated by the oven and needed to develop the film. Using this type of material, conductive heat transfer is minimized and radiant heat transfer is accentuated. In addition, imperfections on the surface of the low thermal mass, low thermal conductivity material which contact the TPM 26 have little or no affect on the development of the TPM 26. An example of a low thermal mass, low heat conductivity material is a Willtec melamine foam having a density of 0.75 pounds per cubic foot (12.0 kg/m3) and a thermal conductivity (K) of approximately 0.30 Btu-inch per hour-foot square-degree Fahrenheit is used for support material 20, specific heat of 0.3 Btu per pound-degree Fahrenheit. Material 20 of this type is commercially available from Illbruck Corp. of Minneapolis, Minn., USA.

Other types of materials having similar or dissimilar thermal characteristics could be used, including silicone or polyimide foam. Materials of greater thermal mass and/or thermal conductivity could be used to increase the conductive heat transfer aspect and the total heat transfer, which could allow for increased throughput.

In one embodiment, the sleeves of support material 20 (melamine foam) can be about 1 inch (2.54 cm) in diameter, and fabricated by coring and grinding a block of stock to a thickness of about 0.25 inch (0.63 cm). The sleeves of material 20 are then mounted to steel rods 18. The center of the upper rollers 14 are spaced a distance D1 of approximately 1.25-inch (approximately 3.2 cm). The same is true of the lower rollers 16.

Figure 3:
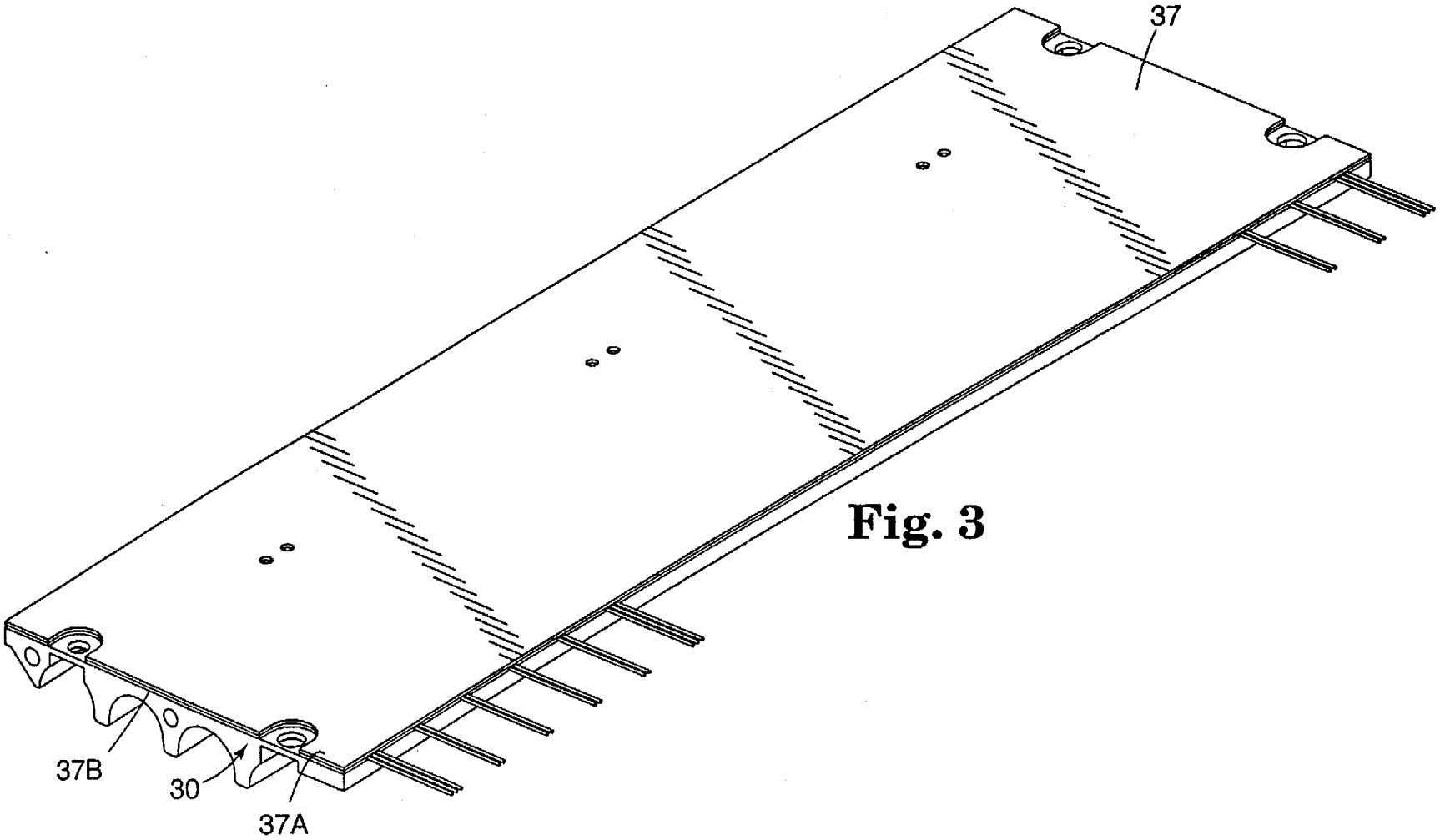
FIG. 3 is a partial side sectional view of the embodiment of the thermal processor shown in FIGS. 1 and 2.

The upper rollers 14 can be positioned, as shown, relative to the lower rollers 16 to cause the TPM 26 to be bent or curved when transported between the rollers 14, 16. Bending or curving the TPM 26 as shown in FIGS. 1 and 3 causes the TPM 26 to have a plurality of curvatures. Each of these curvatures has a curvature axis which is generally perpendicular to transport path of the TPM 26 through the oven 12. By saying "generally perpendicular", it is meant that the axis can be perpendicular to the transport path or close to being perpendicular to the transport path.

Creating these curvatures can be accomplished by positioning the rollers 14, 16 as shown in FIGS. 1 and 3. For example, the rollers 14, 16 can be positioned such that a horizontal line tangent to two or more of the lower portions of upper rollers 16 can be vertically spaced a distance D2 from a horizontal line which is tangent to two or more of the upper portions of the lower rollers 14.

Bending or curving of the TPM 26 increases the column stiffness of the TPM 26 and enables the TPM 26 to be transported through and heated up within the processor 10 without the need for nip rollers or other pressure-transporting means. Consequently, this column stiffness approach minimizes thermally-induced wrinkles of the TPM 26, which often appear in the direction of the transport path or diagonally (like an evergreen tree appearance) as a result of constraints associated with nipping (or other pressure application).

A distance D2 of approximately 0.1 inch (approximately 0.5 centimeter) has been shown to be effective when developing an 18-inch (45.7-centimeter) wide photothermographic film having, for example, a 4-mil (0.01 centimeter) polyester base. The composition of such a film is disclosed in pending U.S. patent application Ser. Nos. 08/529,982; 08/530,024; 08/530,066; and, 08/530,744 (assigned to 3M Company, St. Paul, Minn., USA), which are hereby incorporated by reference. This photothermographic film could be one which is useful as an image-setting film, the length of which can vary from shorter sheets to longer lengths on rolls.

The distance D2, however, can be empirically determined for processing other materials, such as a 14-inch (35.6-centimeter) by 17-inch (43.2-centimeter) sheet of medical imaging film having a 7-mil (0.018 centimeter) polyester base (e.g., DRYVIEWTM DVC or DVB medical imaging film available from 3M Company, St. Paul, Minn., USA). In addition to the material choice, other factors can affect the optimal choice of the distance D2, including the width and the thickness of the material being developed, the transport rate of the material through the processor, and the heat transfer rate to the material.

The upper rollers 14 can be sufficiently spaced apart, as can the lower rollers 16, such that the TPM 26 can expand with little or no constraint in the direction generally perpendicular to the transport path. This minimizes the formation of significant wrinkles across the TPM 26 (generally perpendicular to the direction of the transport path). Furthermore, the minimization of these wrinkles can be accomplished without requiring that the TPM 26 be under tension when transported through the oven 12. This is particularly important when developing a TPM 26 of relatively short length, as opposed long length of material, such as a rollgoods material which can be pulled through the oven 12.

Four heated members 28 are shown as comprising a first upper heated member 30, a first lower heated member 32, a second upper heated member 34, and a second lower heated member 36. The heated members 28 can be heated with blanket heaters, such as the blanket heater 37 shown in FIG. 4 on the first upper heated member 30. The temperature of each blanket heater (and, therefore, heated members 28) can be independently controlled by, for example, a controller and a temperature sensor, such as a resistance temperature device or a thermocouple. Independent control of the heating elements 28 allows for more accurate control and maintenance of the temperature within the oven 12, and more critically, allows for consistent heat flow from the oven 12 to the TPMs 26 transported therethrough.

The thermal processor 10 has the ability to accurately control and maintain the temperature of the oven 12 when the oven 12 is in an idle state (no TPM 26 is being transported therethrough) and when the oven 12 is in a load state (a TPM 26 is being transported therethrough). The thermal processor 10 has the ability to compensate for the greater heat loss from the edges of the heated members 28 when in the idle state and for the additional heat loss in the inner portion of the heated members 28 when in the load state (due to heat flow to the TPM or TPMs 26).

Figure 4:
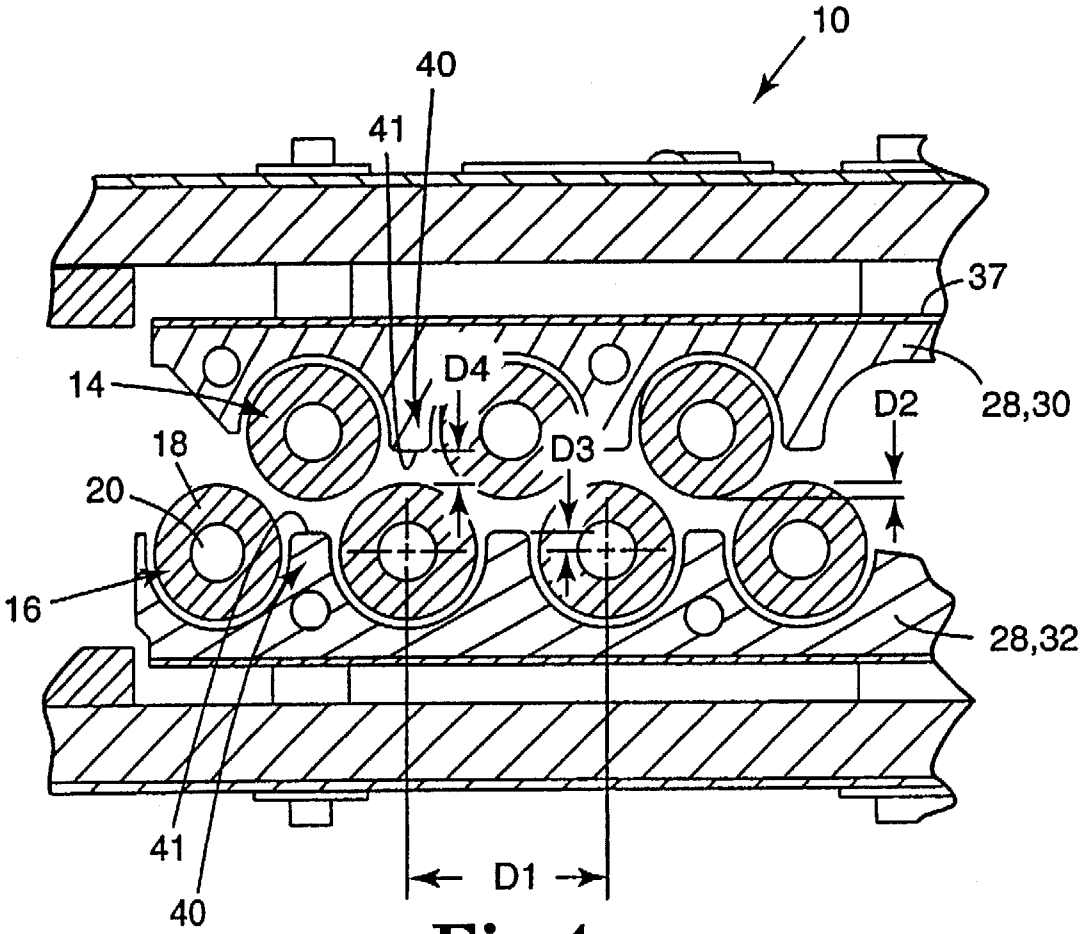
FIG. 4 is an isometric view of a top heating assembly within the embodiment of the thermal processor shown in FIGS. 1–3.

One embodiment of the thermal processor 10 that provides this ability is shown in FIG. 4 as including two blanket heaters 37 for heating a surface of a corresponding heated members 28, one blanket on top of the other. The first of the two blanket heaters 37 could be considered an idle state heater 37A which can be engaged or energized when the oven 12 is in the idle state and in the load state. The idle state heater 37A can be constructed with a particular heat flux density to distribute heat to the corresponding heated member 28 such that greater heat is created at the edges of the blanket 37A and delivered to the edges of the corresponding heated member 28 to compensate for the greater heat loss from the edges of that heated member 28. The second of the two blanket heaters could be considered a load state heater 37B which is engaged or energized when the oven 12 is in the load state. The load state heater 37B can be constructed to have a particular heat flux density to distribute heat to the corresponding heated member 28 such that greater heat is created in the inner portion of the blanket 37B and delivered to the inner portion of the corresponding heated member 28 to compensate for the heat transferred to the TPM 26. Blanket heaters of this type are available from Minco Products, Inc. which is located in Minneapolis (Fridley), Minn., USA.

In effect, this blanket heater arrangement transfers the same amount of heat to particular locations of the corresponding heated member 28 as the amount of heat transferred by those particular locations to the TPM 26. In other words, this arrangement adds heat where transferred to the TPM 26. The result is uniform temperature history of the heated members 28 during the processing of a TPM 26 such that the heat transferred to the TPM 26 is uniform and such that successive TPMs 26 are developed uniformly.

The heated members 28 can be shaped, as shown, to wrap around a circumferential portion of a number of the upper and lower rollers 14, 16. The wrap angle A can preferably range from 120 to 270 degrees of the circumference of a roller. More preferably, the wrap angle is approximately 180–200 degrees, and even more preferably, the wrap angle is approximately 190 degrees.

Another way of setting the degree to which a heated member 28 wraps around a roller is to choose the distance D3 from a heating fin 40, in particular, the fin face 41 of a heating in 40, to a plane created by the longitudinal axis of an adjacent roller. For the above-referenced rollers 14, 16, the distance D3 can be approximately 0.2 inch (0.5 centimeter), although the distance D3 could be greater or lesser.

The mating or wrapping shape and the close proximity of the heating fins 40 relative to the rollers 14, 16 more effectively maintain the temperature of the outer surface of the rollers 14, 16 as the rollers 14, 16 contact a TPM 26. This close, mating or wrapping arrangement causes the rollers 14, 16 to more uniformly transfer heat to the TPM 26.

With this wrapping arrangement, portions of the heated members 28 function as heating fins 40. The heating fins 40 fit between and relatively close to the rollers 14, 16. For example, the heating fins 40 are preferably as close as possible to the rollers 14, 16 without contact the rollers 14, 16.

By minimizing the size of the gap between the fin face 41 of a heating fin 40 and the TPM 26, radiant heat transfer efficiency and the conductive heat transfer efficiency (through a thinner layer of air) is increased. However, the size of the gap should be sufficient to prevent contact with the TPM 26 when no contact is desired, or sufficient to prevent the leading edge of a TPM 26 from catching on a heating fin 40 and possibly jamming the TPM 26 within the thermal processor 10.

The gap size between a fin face 41 and the TPM 26 can be indirectly set by choosing the distance D3 from a fin face 41 to a line tangent to a lower roller 16 positioned directly below or an upper roller 14 positioned directly above the fin face 41. For a 4-mil polyester base TPM 26, such as the previously described image-setting film, the distance D3 is preferably not significantly less than 0.2 inch (0.5 centimeter). For other materials, the minimum distance for distance D3 may be different.

The thinner layer of air within the gap also minimizes the effect of convective currents that can form and flow across the TPM 26. This, in turn, can minimize inconsistent convective heat transfer to the TPM 26 and inconsistent development of the photothermographic image.

The gap size is more consistently maintained by bending the TPM 26, as previously described, when the TPM 26 is transported adjacent to the heating fins 40. By bending the TPM 26, the increased column stiffness of the TPM 26 prevents or reduces the buckling of the TPM 26 when transported between the rollers 14, 16. And, as previously stated, this approach requires minimal pressure on the TPM 26 (e.g., no nipping of the TPM 26) as opposed means of positioning the TPM 26 relative to the fin faces 41.

The dimension and composition of the heated members 28 can be chosen to optimize their thermal mass. With optimal thermal mass, an acceptable variation of the temperature of the heated members 28 can be matched with an acceptable period of time required to heat each of the heated members 28 to a desired temperature. Minimizing the temperature variation is important as the temperature difference ($\Delta T_{rad}$) between the TPM 26 and the fin face 41 is a factor in the radiant heat transfer equation. Similarly, the temperature difference ($\Delta T_{cond}$) between the TPM 26 and the heated air adjacent to the TPM 26 is a key factor in the conductive heat transfer equation. And, maintaining the desired temperature differences ($\Delta T_{rad}$ and $\Delta T_{cond}$) is a key factor in uniform development within a TPM 26 and from one TPM 26 to the next.

To develop a length of the previously described image-setting film (TPM 26), the first upper and lower heated members 30, 32 are heated to approximately 275 degrees Fahrenheit (135 degrees Celsius) and the second upper and lower heating members 34, 36 are heated to approximately 260 degrees Fahrenheit (127 degrees Celsius). At these temperatures, the TPM 26 is preferably transported at a rate of 0.4 inch per second (1 centimeter per second). At this rate and these temperatures, the length of the first upper and lower heating members 30, 32 can preferably be approximately 6 inches (15.2 centimeters) and the length of the second upper and lower heating members 34, 36 can preferably be approximately 6 inches (15.2 centimeters).

To thermally process other thermally processable materials, these temperatures, lengths, and the transport rate can be adjusted as necessary. Similarly, to increase the throughput rate of the thermal processor 10, the transport length could be increased.

Heating the first upper and/or first lower heating members 30, 32 to higher temperatures than the second upper and/or second lower heating members 34, 36 (as noted above) provides, in essence, the oven 12 with two zones. This two-zone configuration is an effective way of increasing the throughput and minimizing the footprint of the thermal processor 10.

Within the first zone (the first zone being created by the first upper and lower heated members 30, 32, the corresponding rollers 14, 16, and the heated air adjacent to the heated members and the rollers), an amount of heat is transferred to the TPM 26 to rapidly heat the TPM 26 to within a target processing temperature range, such as approximately 240–260 degrees Fahrenheit (115–127 degrees Celsius). The transport rate of the TPM 26 through the oven 12 can be set such that the TPM temperature reaches, but does not yet exceed, the target processing temperature range when the TPM 26 is moving out of the first zone and into the second zone. (If transported more slowly through the first zone, the TPM 26 could be heated to above the target processing temperature range.)

The temperature of the second zone (second zone being created by the second upper and lower heated members 34, 36, the corresponding rollers 14, 16, and the heated air adjacent to the heated members and the rollers) can be set such that the TPM temperature is maintained within the target processing temperature range for a target dwell time. The target dwell time within the second zone is determined by the length of the second zone and by the transport rate of the TPM 26 through the second zone.

Figure 5:
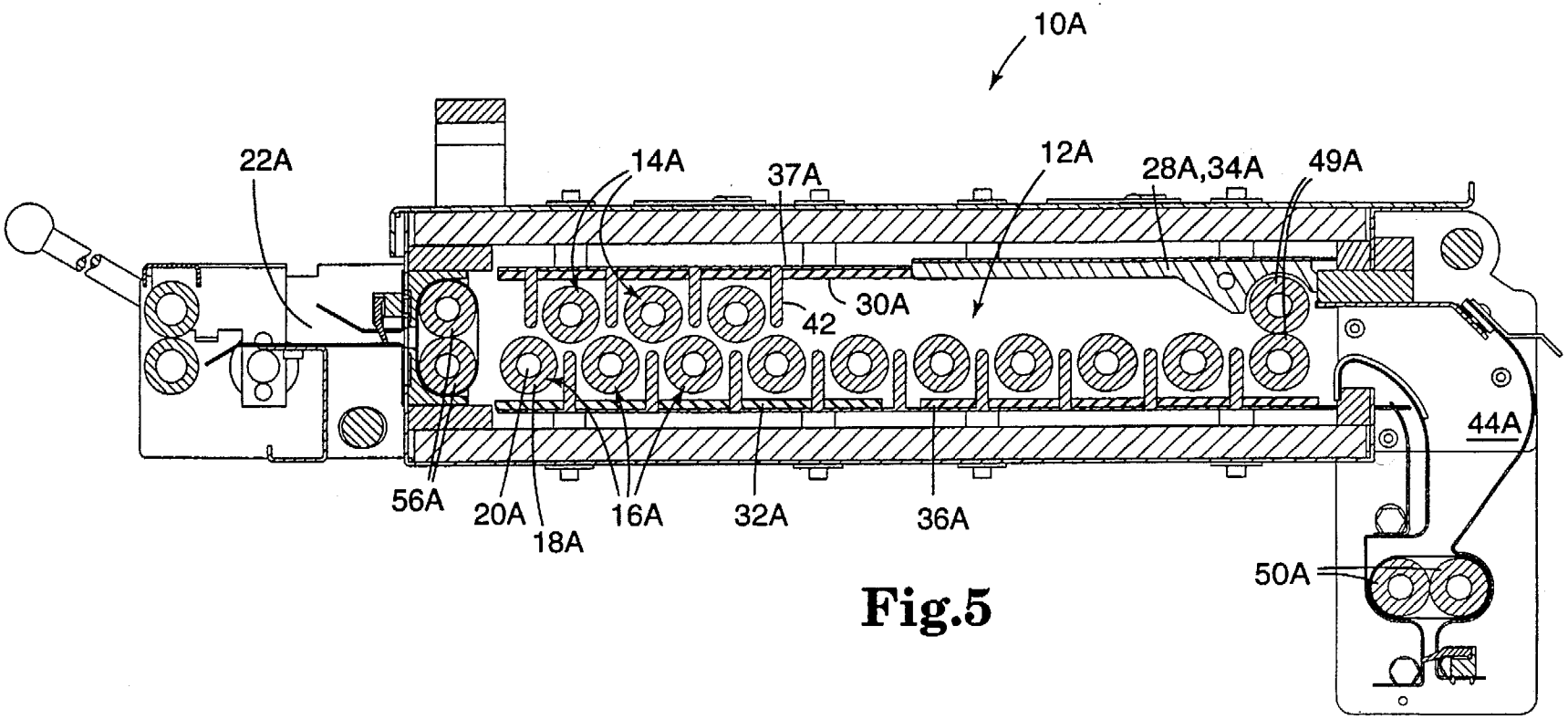
FIG. 5 is a side sectional view of another embodiment of the thermal processor in accordance with the present invention.

In FIG. 5, another embodiment of the thermal processor 10A includes screens 42A in place of the heating fins to minimize the effect of convective currents (created by the heated members 28A) on the development of the photothermographic image. The screens 42A are physical barriers positioned between many of the lower rollers 16A to stop or divert the flow of air currents along the surface of the TPM 26A (for example, the emulsion side when the emulsion side is adjacent to the lower rollers 16A). The screens 42A do not necessarily provide other advantages which are provided by the previously described heated fins 40.

Figure 2:
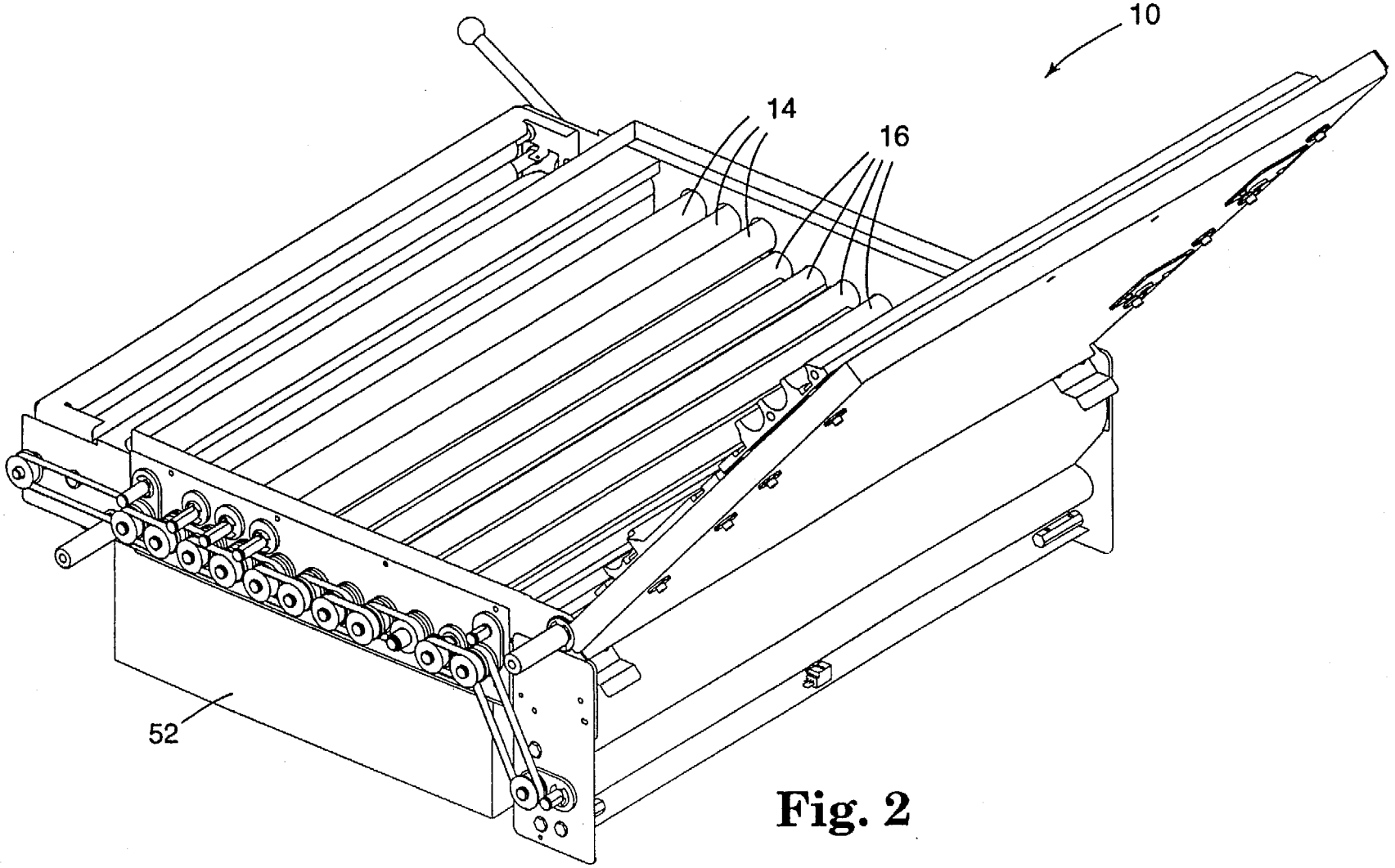
FIG. 2 is an isometric view of the embodiment of the thermal processor shown in FIG. 1 having an opened cover.

From the oven 10, the TPM 26 is transported into a cooling chamber 44, as shown in FIGS. 1 and 2. This portion of the thermal processor 10 is intended to lower the temperature of the TPM 26 to stop the thermal development while minimizing the creation of wrinkles in the TPM 26, the curling of the TPM 26, and the formation of other cooling defects.

Figure 6:
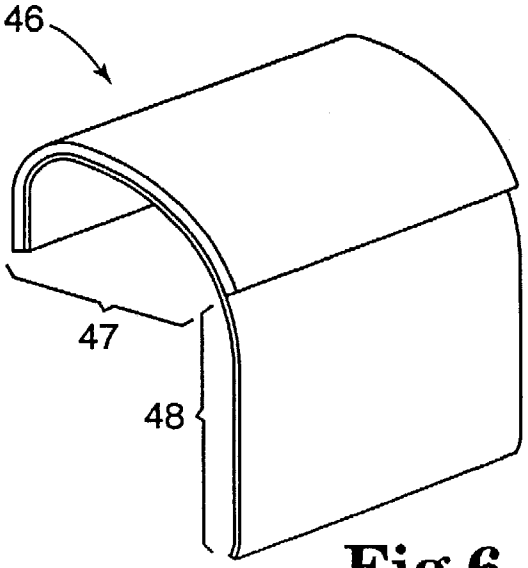
FIG. 6 is a isometric view of a cooling member within the thermal processor shown in FIGS. 1 and 5.

The cooling chamber 44 can include a cooling surface 46 (a portion of which is shown in FIG. 6) over which the TPM 26 rides. The cooling portion includes a first cooling portion 47 which is curved and a second cooling portion 48 which is relatively straight. Contact between the heated TPM 26 and the curved, first cooling portion 47 cools the TPM 26 while the TPM 26 is curved or bent. The degree of curving or bending increases the column stiffness of the TPM 26 which minimizes the formation of wrinkles. For cooling the previously mentioned image-setting film, the radius of the first cooling portion 47 where the TPM 26 contacts the first cooling portion 47 can be approximately 1.5 inches (3.8 centimeters).

The location of the first cooling portion 47 is important in that the TPM 26 is curved and be cooled by the first cooling portion 47 just after the TPM 26 exits the oven 12, that is, just after the TPM 47 is heated to the development processing temperature range for the desired dwell time. With the correct location, curvature, contact time with the TPM 26, and cooling rate caused by contact with the TPM 26, the first cooling portion 47 can cool a heated, curved TPM 26 through a temperature range which would cause wrinkling if not for the fact that the first cooling portion 47 caused the TPM 26 to be curved during this critical cooling stage. Restated, the curving or bending of the TPM 26 when the TPM 26 is most susceptible to formation of cooling-induced wrinkles significantly reduces the formation of these wrinkles.

The shape of the cooling surface 46 and the transport rate of the TPM 26 can be set such that the TPM 26 contacts the second cooling portion 48 while the TPM 26 is still cooling. Because the final cooling of the TPM 26 occurs while the TPM 26 is straight (or more straight than when contacting the first cooling portion 47), curling of the TPM 26 can be reduced.

To control the cooling rate due to contact with the cooling surface 46, the cooling surface 46 can be made of a combination of materials. Each of the materials can have a different thermal conductivity. For example, the entire cooling surface 46 can be made of a relatively high thermal conductivity material (e.g., aluminum or stainless steel). A lower thermal conductivity material (e.g., velvet or felt) can cover all or part of the first cooling portion 47 (shown as the layer between the TPM 26 and the higher thermal conductivity material).

A preferred choice for the higher thermal conductivity material is a textured, 20-gage 304 stainless steel available from Rigidized Metals Corporation, (658 Ohio St., Buffalo, N.Y. 14203). A preferred texture is referred to as Rigitex pattern 3-ND. A preferred choice for the lower thermal conductivity material is a velvet available from J.B. Martin Company, Inc. (10 East 53rd Street, Suite 3100, New York, N.Y.) and is referred to by J. B. Martin as Style No. 9120, nylon pile/rayon backed, heatseal coated, light-lock velvet.

With this construction, the TPM 26 contacts the lower thermal conductivity material and the first cooling portion 47 of the cooling surface 46 as or just after the TPM 26 exits the oven 12. Then, the TPM 26 contacts the higher conductivity material and the second cooling portion 48 of the cooling surface 46 to complete the cooling process. Proper control of the cooling rate coupled with the curving or bending of the TPM 26 during the initial cooling process results in minimized wrinkles. The choice of the radius of the first cooling portion 47 and the choice of the material can change based on the type of TPM 26 being cooled and the transport rate desired.

The TPM 26 can be transported to the cooling surface 46 with a first pair of nip rollers 49 and transported from the cooling surface 46 by a second pair of nip rollers 50. The nip rollers 49, 50 can be coordinated such that the entire TPM 26 or a significant surface area of the TPM 26 contacts the cooling surface while being transported at approximately the same rate. This causes the TPM 26 to be more uniformly cooled and the development more uniformly halted.

The thermal processor 10 can also include means for causing air flow within the cooling chamber 44. Two streams of air can be useful, one for cooling the cooling surface 46 and one for removing and filtering air within the chamber 44 and within the oven 12. The first stream S1 can be a stream of ambient air (or cooling air) which is directed at the side of the cooling surface 46 opposite to the side of the cooling surface 46 which contacts the TPM 26. The first stream S1 can be created by a first fan 54 which pulls air in from outside the thermal processor 10 and directs the air against the cooling surface 46. The air can exit to outside the thermal processor 10 through an outlet.

The first stream S1 can have a flow velocity which is suited to cool the cooling surface 46 so that the entire length of a TPM 26 is uniformly cooled and so that successive TPMs 26 are uniformly cooled. Because this flow velocity may be excessive if flowing across the TPM 26 (thereby possibly causing excessively rapid cooling of the TPM 26 which can result in wrinkles), the first stream S1 is contained to that the first stream S1 does not directly contact the TPM 26. The first fan 54 can be chosen to create a volumetric flow rate of approximately 6–10 cubic feet per minute and an air velocity against the cooling surface 46 of approximately 3–9 feet per second (0.9–2.7 meters per second).

The second stream S2 of air within the cooling chamber 44 can flow adjacent to the TPM 26 to remove the gaseous bi-products. The second stream S2 can flow through the thermal processor 10 beginning at the oven entrance 22 and terminating at a filtering mechanism 52. The flow rate of the second stream S2 can be sufficiently low that the cooling of the TPM 26 by the second stream 52 does not create a wrinkling problem. A target volumetric flow rate could be approximately one air change per minute through the thermal processor 10.

The filtering mechanism 52 can create the second stream S2 by including means for pulling air through the oven 12, such as a second fan (not shown). The filtering mechanism 52 also includes a filter (not shown) which is designed to handle the gaseous bi-products created when certain photothermographic materials are thermally developed. An example of such a filtering mechanism 52 is described in U.S. Pat. No. 5,469,238 and pending U.S. patent application Ser. No. 08/239,888 (assigned to 3M Company) which are hereby incorporated by reference.

A third pair of nip rollers 56 are shown near the entrance 22 of the oven 12. In addition to transporting the TPM 26 into the oven 12, the third pair of nip rollers 56 partially seal the entrance 22. The space between the third pair of nip rollers 56 and the external walls adjacent to the nip rollers 56 is sufficiently small to prevent free exchange of air in and/or out of the entrance 22. However, the space can be sufficiently large to allow just enough air to supply the second stream S2 which flows to the filtering mechanism 52. Therefore, the air flow into the oven 12 through the entrance is controlled. This can be important in preventing non-uniform development due to uncontrolled air flow against the TPM 26.

The third pair of nip rollers 56 could more completely seal off the oven entrance 22 with a tighter fit with the external walls adjacent to the third pair of nip rollers 56. This further prevents the effects of the air flow from the entrance 22 and across the TPM 26. With a complete seal, the thermal processor 10 would either be without a second stream S2 or would require another source, such as an opening in another location in the oven 12.

Another embodiment (not shown) could have the heating members 30, 32 wrapping around the third pair of nip rollers 56 in order to heat them like the other rollers 14, 16, 49 within the oven 12. This could provide even greater control of the heat being transferred to the TPM 26.

Although the present invention has been described with reference to preferred embodiments, those skilled in the art will recognize that changes may be made in form and detail without departing from the spirit and scope of the invention. For example, the transport path can have other than the horizontal, generally straight orientation which is shown (e.g., an inclined straight transport path, a vertical straight transport path, an arched transport path, and the like). Also, a greater or lesser number of rollers 14, 16 could be used within the oven 12.

Still further, other blanket heater arrangements could be used. For example, a three-layer approach could be used. The upper layer could be the idle blanket heater, like that shown. The middle layer could be a first load blanket heater having a particular heat flux density which was chosen to compensate for the heat transfer to a TPM 26 having a width of, for example, 10 inches (25.4 centimeters). The lower layer could be a second load blanket heater having a particular heat flux density which was chosen to compensate for the heat transferred to a TPM 26 having a width of, for example, 20 inches (50.8 centimeters). With this dual capability, the thermal processor 10 could include a control (manual or automatic) which engages either the first load blanket heater or the second load blanket heater depending on which TPM 26 is being transported into the thermal processor 10. Additional blanket heaters could of course be added to provide the ability to handle TPMs 26 of different widths.

Sensors, such as edge-detecting sensors, at the oven entrance 22 could be used to sense the edge locations of the incoming TPM 26 and send a signal to a controller within the thermal processor 10. The controller could be designed to determine the width of the TPM 26 based on this signal and to engage the appropriate load blanket heater. Furthermore, this sensing approach could be used with heating means other than the overlapping blanket heaters, such as a single blanket heater. Such a single blanket heater could include multiple, independently-controllable zones such that the appropriate zones could be engaged or energized to process TPMs 26 of different widths.

Figure 7:
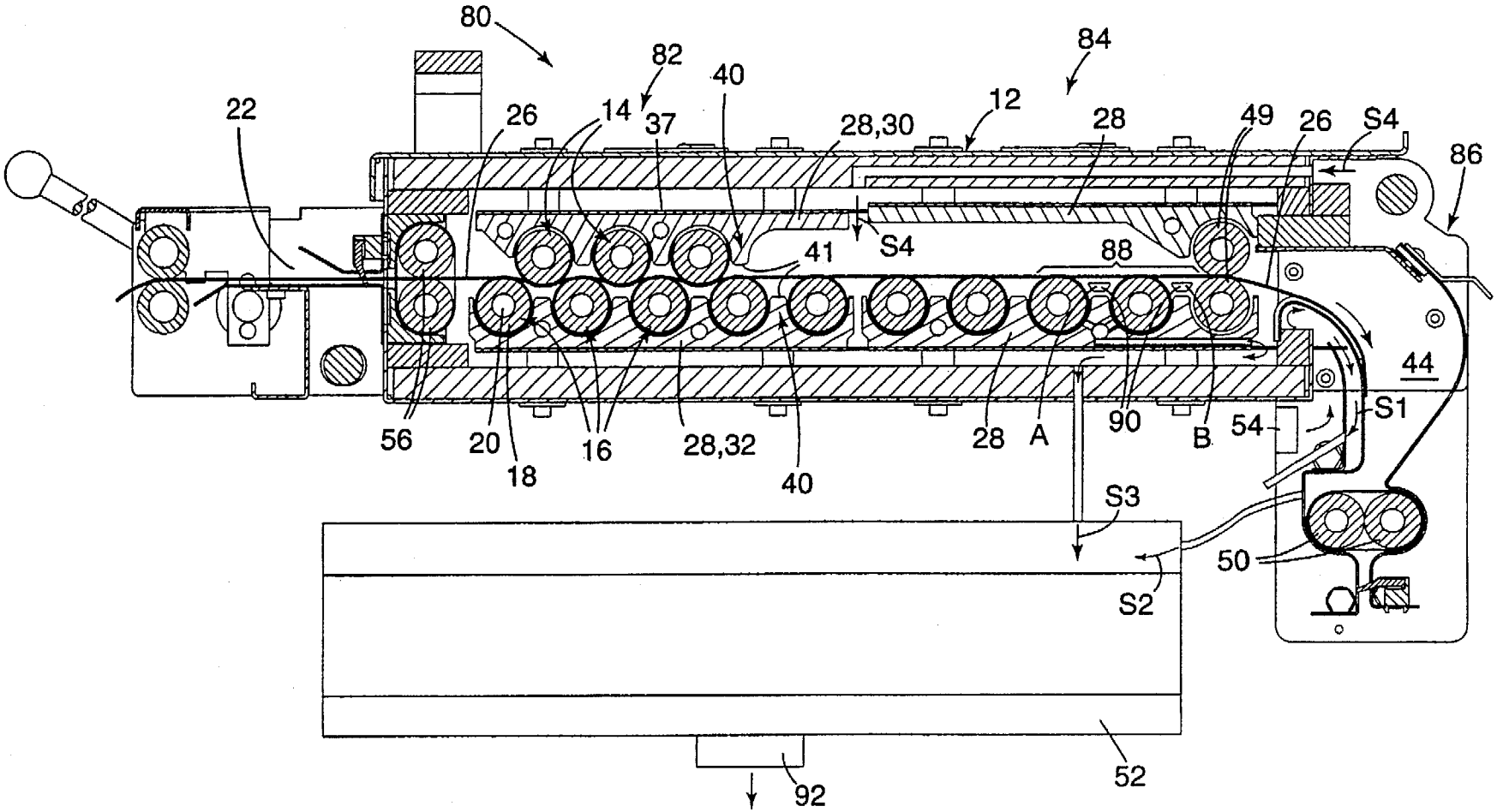
FIG. 7 is a side sectional view of another embodiment of a thermal processor in accordance with the present invention.

Referring to FIG. 7, another embodiment of the thermal processor in accordance with the present invention is generally shown at 80. The thermal processor 80 can be similar to the thermal processor 10 as previously described herein. In this embodiment, the thermal processor 80 includes an apparatus and method to reduce fogging of the image material, a phenomena which may occur as an image is thermally developed in an imaging material.

As previously described herein, the thermal processor 80 generally includes a preheat section 82, a dwell section 84, and a cooling section 86. The thermally processable material 26 follows a transport path through the preheat section 82 where it is heated to at least approach a temperature necessary for development, through the dwell section 84 where development of the thermally processable material 26 occurs, and through cooling section 86 for cooling of the thermally processable material 26. It is a known practice to develop negative images in the thermally processable material 26 as it advances through the thermal processor 10. As such, as the heated thermally processable material 26 is transported through the dwell section 84, the thermal processor 80 causes the areas of the thermally processable material 26 that were exposed to light (prior to processing) to develop and turn dark. Unexposed areas of the thermally processable material 26 remain transparent.

Under certain conditions, however, it has been found that unexposed areas of the thermally processable material can darken, and exposed areas of the thermally processable material 26 may further darken to an undesirable degree. This phenomena has become known as "fogging" of the thermally processable material. Fogging of the thermally processable material can undesirably increase the dot percentage in a percent dot exposure, or fill in large areas of the image exposed on the thermally processable material, depending on the severity of the fog.

Tests have shown that the chemistry of the thermally processable material is such that as the imaged areas are developed and turn black, a fog-producing gaseous by-product is emitted from the thermally processable material. If the gaseous by-product emitted from the thermally processable material is allowed to build up inside the thermal processor 80 and come in contact with unexposed areas of the thermally processable material 26, the gaseous by-product will fog the thermally processable material 26, resulting in unwanted developed or blackened areas.

The present invention includes an apparatus and method for reducing or eliminating fogging during development of images in the thermally processable material as it is transported through the thermal processor. In particular, the present invention includes an apparatus and method of removing the gaseous by-product which causes fogging of the thermally processable material, before reaction with the thermally processable material, without interrupting or affecting the development process. Although in one embodiment, a negative imaging process is described herein, the present invention applies equally to processes employing negative imaging or positive imaging techniques. The present invention applies to thermal processing techniques, including thermal graphic and photothermal graphic processing systems.

In FIG. 7, one embodiment of the fog reducing apparatus and method in accordance with the present invention is generally shown. In the embodiment described in detail herein, the thermally processable material 26 is transported through the thermal processor 80 with the emulsion side down. It is also recognized that the thermally processable material 26 may be transported through the thermal processor 80 with the emulsion side up, which will be described later in the specification.

In general, as the thermally processable material 26 is transported through the dwell section 84, in response to the heat, the image is developed in the thermally processable material and turns dark. This occurs in the latter part of the dwell section 84, indicated as developing section 88. As the imaged areas on the thermally processable material 26 darken, a fog-producing gaseous by-product 90 (indicated as a cloud) is emitted from the thermally processable material 26 (shown as fog region A and fog region B).

Before the fog-producing gaseous by-product 90 damages or "fogs" the thermally processable material 26, the gaseous by-product 90 is evacuated from the thermal processor dwell section 84. In operation, the gaseous by-product 90 is evacuated from the dwell section 84, indicated by arrows S3, through filtering mechanism 52 using exhaust fan 92. The gaseous by-product 90 is replaced by fresh makeup air brought into the dwell section 84, indicated by arrows S4. As the makeup air is brought into the dwell section 84, it is heated to the approximate temperature of the thermally processable material 26, such that it will not affect the development of thermally processable material 26.

Figure 8:
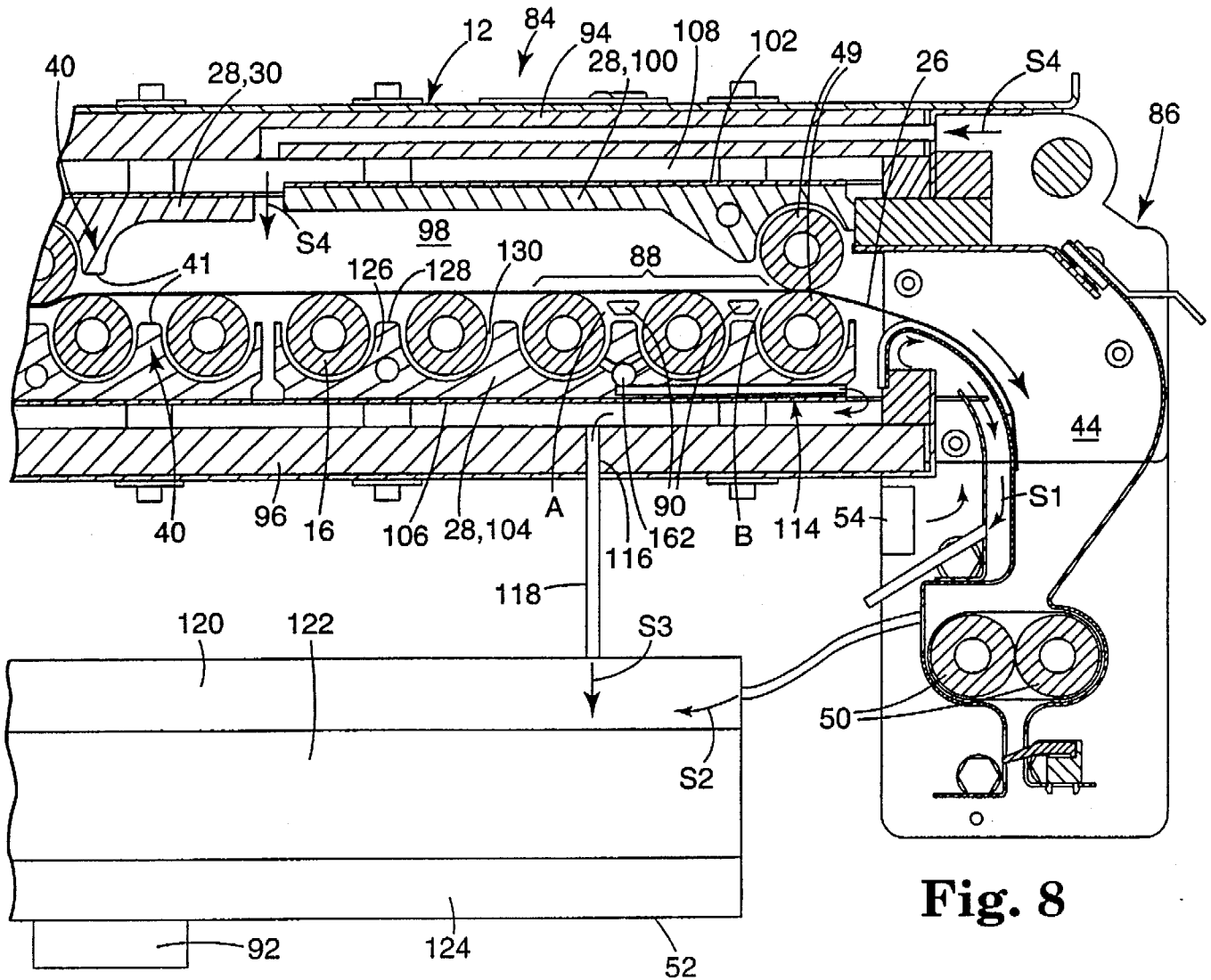
FIG. 8 is an enlarged partial side sectional view of the embodiment of the thermal processor shown in FIG. 7.

Referring to FIG. 8, an expanded side sectional view of the dwell section 84 of the thermal processor 80 is shown. Heated enclosure or oven 12 includes a top insulation layer 94 and a bottom insulation layer 96. Within dwell section 84, a heated dwell chamber 98 is enclosed by an upper heated member 100 thermally coupled to a heating blanket 102, and a lower heated member 104 thermally coupled to a lower blanket heater 106. Top insulation layer 94 includes a makeup air passageway 108 which allows fresh makeup air from a location outside the oven 12 to enter the dwell chamber 98.

Lower heated member 104 includes a plurality of exhaust air passageways 114 (one shown). One embodiment of the exhaust air passageways 114 is described in detail later in the specification. Further, bottom insulation layer 96 includes an air passageway 116. The air passageway 116 is coupled to filtering mechanism 52 through a tubular member 118. The filtering mechanism 52 is in communication with exhaust fan 92. In one embodiment, the filtering mechanism 52 is a carbon filtering mechanism, which includes a first plenum 120, a carbon filter 122, and a second air plenum 124.

In one embodiment, heated member 104 is formed of aluminum. Heated member 104 generally includes a plurality of heating fins 126, having fin faces 128, adjacent curved regions 130. Rollers 16 nest within the curved regions 130, as previously described herein. A longitudinal exhaust air passageway 162 extends longitudinally through the lower heated member 104. The cross sectional area of a single exhaust air flow channel through a longitudinal exhaust air passageway, for example, as formed by the thermally processable material 26, roller 16, and a fin face 128, is approximately 0.02 inches squared. Exhaust fan 92 has a 7.9 watt, 12 volt DC rating as manufactured by Comair. The exhaust fan 92 has a total volumetric flow of eight cubic feet per minute.

Figure 9:
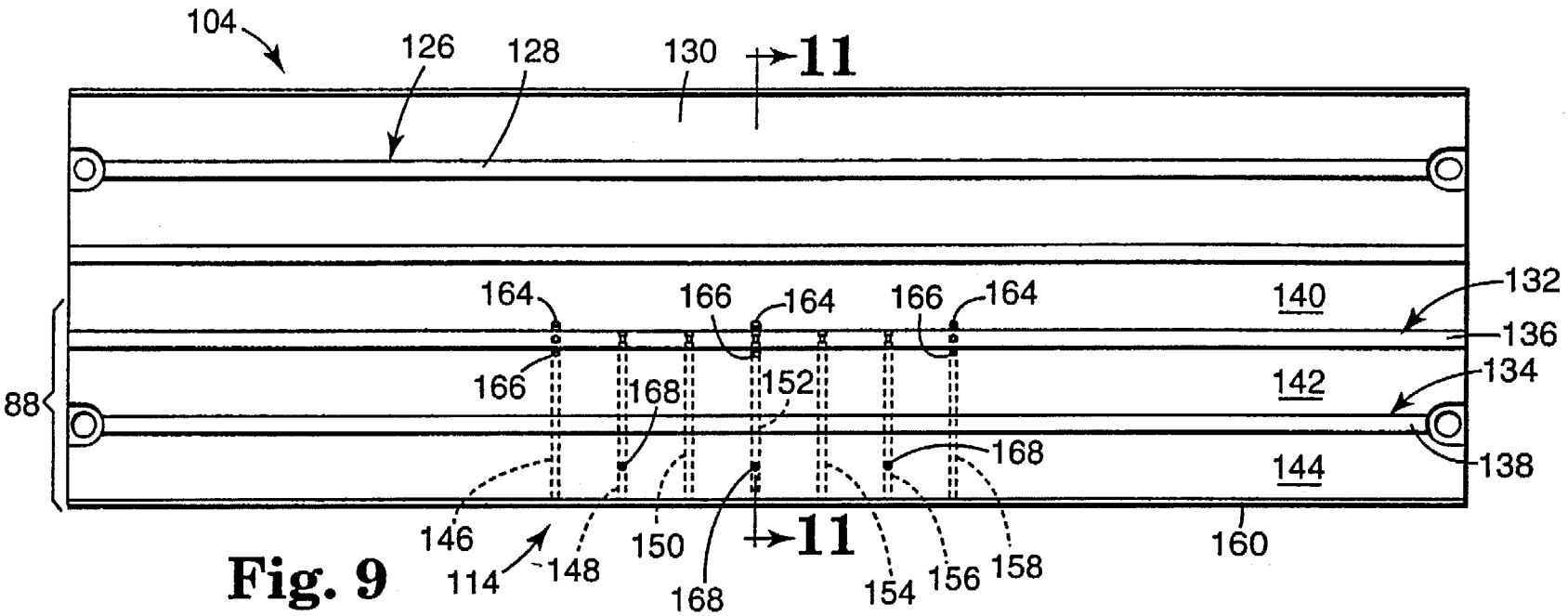
FIG. 9 is a top view of the lower heated member shown in FIG. 7.

Referring to FIG. 9, a top view of heated member 104 is shown. The heating fins 126, fin faces 128 and curved regions 130 extend longitudinally across lower heated member 104. Within developing area 88, the lower heated member 104 specifically includes heating fin 132, heating fin 134, fin face 136, fin face 138, curved region 140, curved region 142, and curved region 144.

Exhaust air passageways 114 are centrally located within the heated member developing area 88. For example, in the embodiment shown, the exhaust air passageways 114 include a first exhaust air passageway 146, a second exhaust air passageway 148, a third exhaust air passageway 150, a fourth exhaust air passageway 152, a fifth exhaust air passageway 154, a sixth exhaust air passageway 156, and a seventh exhaust air passageway 158. Each exhaust air passageway 114 is generally tubular shaped and extends between an edge 160 of lower heated member 104 and the longitudinal exhaust air passageway 162 (shown in FIG. 11). First exhaust air passageway 146, fourth exhaust air passageway 152, and fifth exhaust air passageway 158 include a first port 164 opening into curved region 140 and a second port 166 opening into curved region 142. Second exhaust air passageway 148, fourth exhaust air passageway 152, and sixth exhaust air passageway 156 include a proximal port 168 opening into curved region 144.

Figure 10:
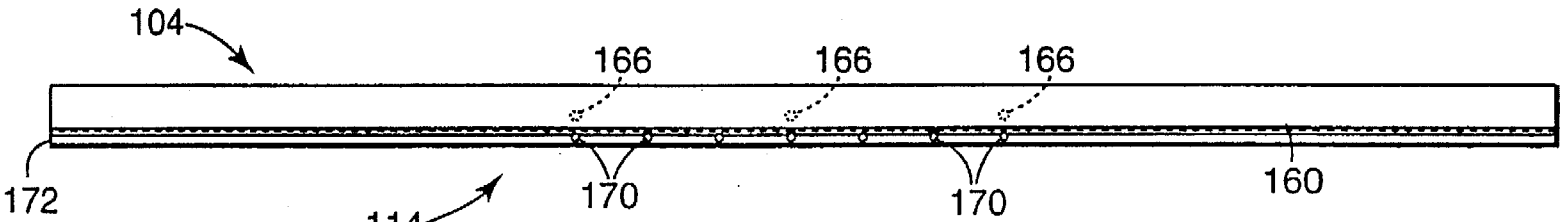
FIG. 10 is an end view of the lower heated member shown in FIG. 7.

Referring to FIG. 10, each exhaust air passageway 114 includes an opening 170 along the edge 160. In one example, the exhaust air passageways 114 are located 25.4 mm apart on center, with the first exhaust air passageway 146 being located 190.5 mm from an edge 172 of the lower heated member 104.

Figure 11:
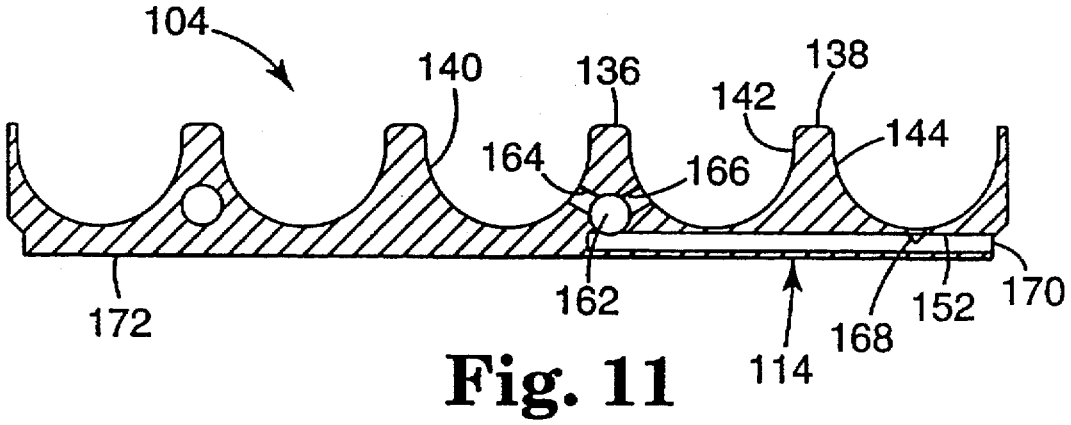
FIG. 11 is a sectional view taken along line 11—11 of FIG. 9.

Referring to FIG. 11, a cross-sectional view of the lower heated member 104 taken along line 11—11 of FIG. 9 is shown. In the example shown, the fourth exhaust air passageway 152 extends 63.6 mm between edge 160 and longitudinal exhaust air passageway 162. The fourth exhaust air passageway 152 is generally tubular shaped having an inside diameter of approximately 2.79 mm, and includes an opening into proximal port 168 and longitudinal exhaust air passageway 162. The proximal port 168 has a relatively short tubular shape with an approximate inside diameter of 2.79 mm, and opens proximate the mid-point of curved region 144. First port 164 and second port 166 are generally tubular shaped having an inside diameter of 3.25 mm. First port 164 and second port 166 extend outward from the longitudinal exhaust air passageway 162, in communication with the curved region 140 and the curved region 142, respectively, at an approximate angle of 30° relative to the horizontal plane, wherein the horizontal plane is defined by a bottom surface 172 of the lower heated member 104.

Figure 12:
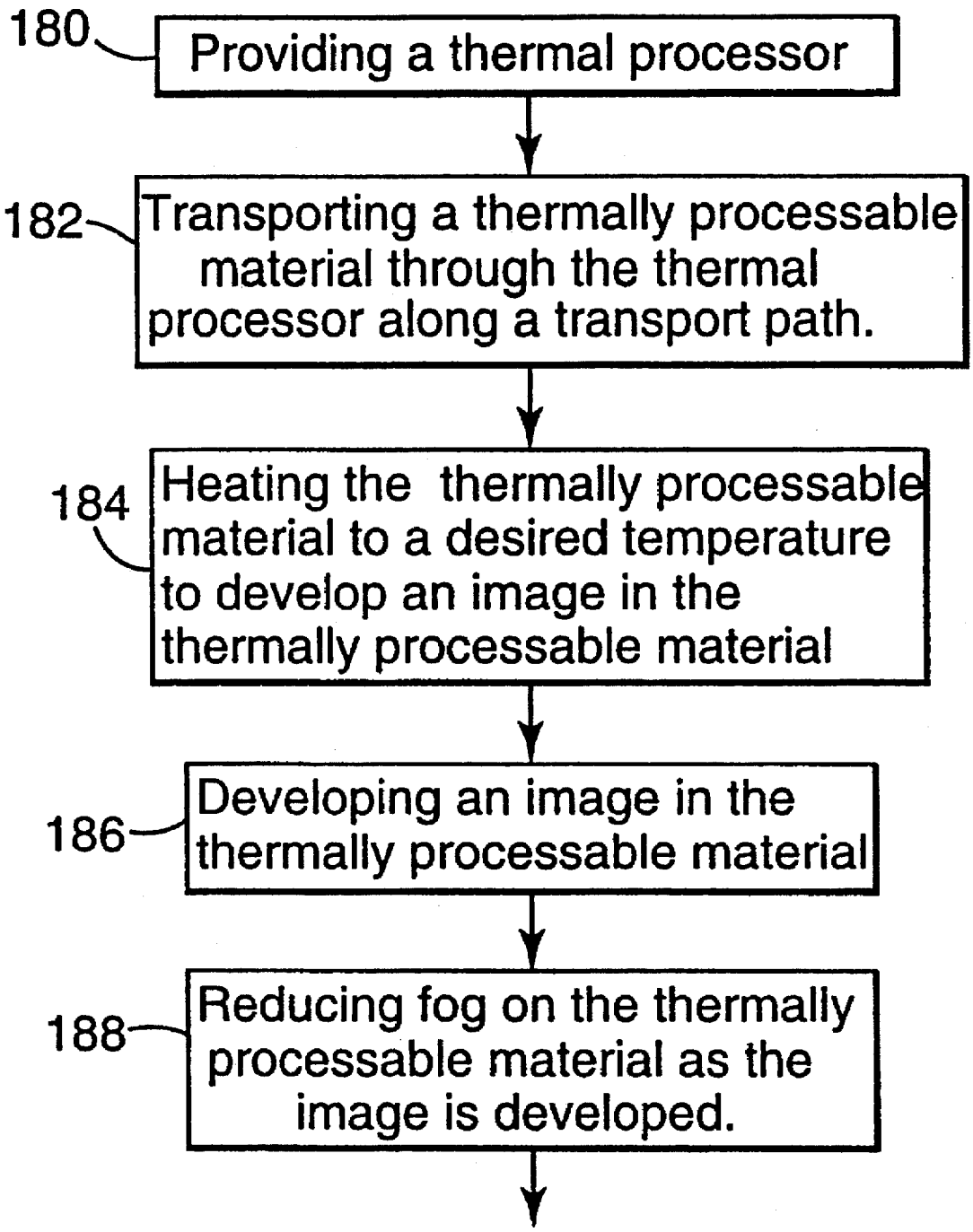
FIG. 12 is a process block diagram showing one method of operation of the thermal processor in accordance with the present invention.

In operation, the present invention includes a method for reducing fog on the thermally processable material 26. Referring to the process diagram of FIG. 12, the method includes providing a thermal processor (180). The thermally processable material 26 is transported through the thermal processor 80 along a transport path (182). The thermally processable material 26 is heated as it passes through the thermal processor 80 from its first initial temperature to a relatively higher developing temperature (184). The image is developed on the thermally processable material 26 (186). The method further includes reducing fog on the thermally processable material 26 as the image is developed on the thermally processable material 26 (188).

Figure 13:
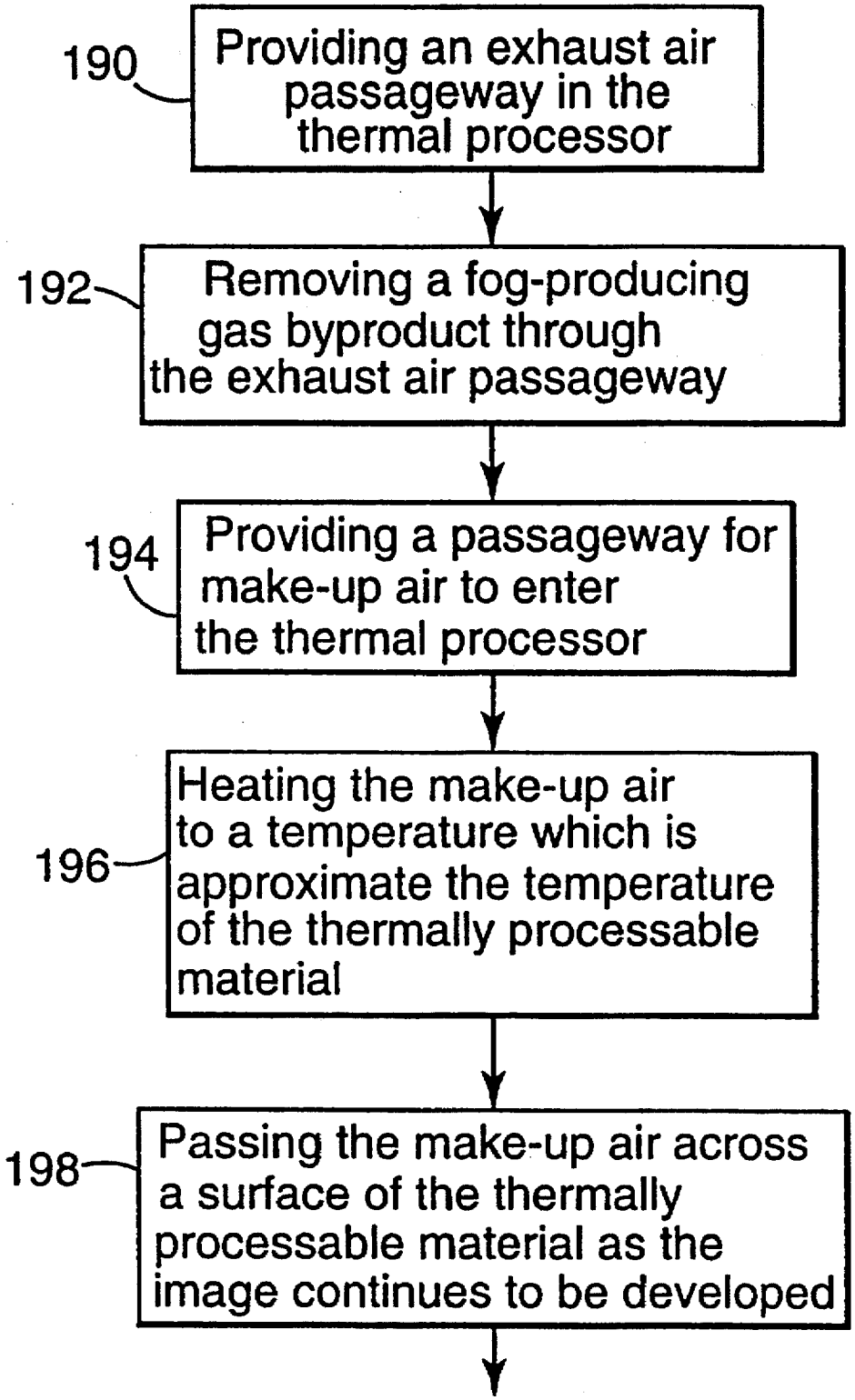
FIG. 13 is a process block diagram showing another method of operation of the thermal processor in accordance with the present invention.

Referring to FIG. 13, the method of reducing the fog on the thermally processable material 26 as the image is developed may further include providing an exhaust air passageway in the thermal processor 80 (190). Air is exchanged adjacent the film surface. A fog-producing gas by-product is removed from the thermal processor through the exhaust air passageway 114 (192). It is recognized that the fog-producing gas by-product 90 may be removed through the exhaust air passageway 114 through the use of exhaust fan 92, which causes the gaseous by-product 92 flow from the thermal processor 80. The makeup air passageway 108 is provided for allowing fresh makeup air S4 to enter the dwell section chamber 85 of the thermal processor 80 (194). As the fresh makeup air S4 passes through the makeup air passageway 108 and into the dwell section chamber 85, the fresh makeup air S4 is heated to a temperature which is approximate the temperature of the thermally processable material 26 (196). In one embodiment, the fresh makeup air S4 is directed along a path across the surface of the thermally processable material 26, generally perpendicular to the direction of movement of the thermally processable material 26, as images continue to be developed on the thermally processable material 26 for continuous removal of the fog-producing gaseous by-product 90 (198).

Figure 14:
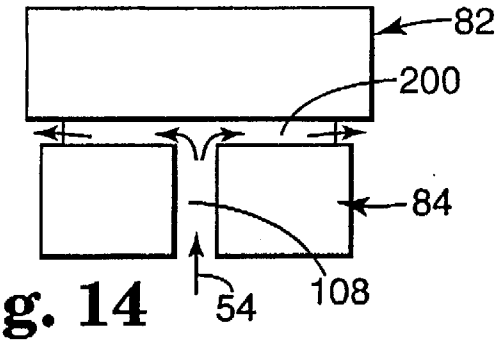
FIG. 14 is a schematic diagram showing one embodiment of makeup air flow through the thermal processor shown in FIG. 7.

Referring to FIG. 14, a schematic diagram showing the general air flow of the makeup air as it enters the thermal processor 80 is shown. The direction of the makeup air flow is represented by arrows S4. In operation, fresh makeup air S4 passes through makeup air passageway 108. As the makeup air exits the makeup air passageway 108, it travels downward and across a gasket seal 200 between the preheat section 80 and the dwell section 84. The gasket seal 200 is approximately the width of the thermally processable material 26 and seals between the preheat section 82 and dwell section 84. Upon reaching the edges of the gasket seal 200, the makeup air S4 continues downward through the dwell chamber 85.

Referring again to FIGS. 7 and 8, during operation of the thermal processor 80, air is exchanged adjacent the thermally processable material 26 and the gaseous by-product 90 is evacuated from the thermal processor 80, thereby reducing fogging of the thermally processable material 26. Exhaust fan 92 is operated to create a negative air pressure within the thermal processor 80, drawing air from the thermal processor dwell section 84. In one preferred embodiment, air is moved in a direction generally perpendicular to the movement of the thermally processable material 26. Upon operation of exhaust fan 92, makeup air is drawn in through makeup air passageway 108, indicated by arrow S4, through top insulation area 94, and into the dwell section chamber 85. Since the temperature within the dwell section 84 is approximately 260° F., it is desirable to heat the fresh makeup air to a temperature which is approximate the temperature of the dwell section 84. The makeup air is heated as the makeup air passes through the makeup air passageway 108. Further, the makeup air continues to heat to a higher temperature as it is passes upper blanket heater 102 and upper heated member 100.

Figure 15:
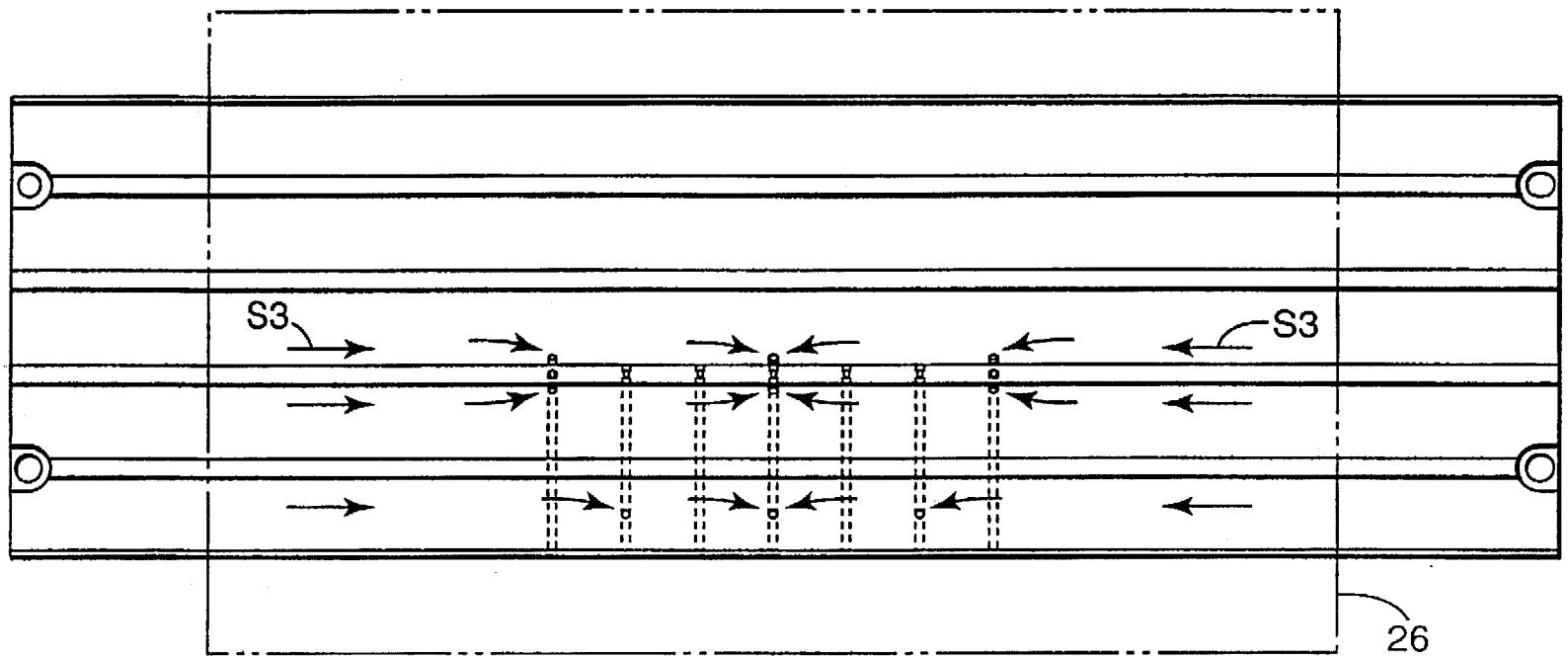
FIG. 15 is a schematic diagram showing one embodiment of exhaust air flow through the thermal processor of FIG. 7.

Referring to FIG. 15, a schematic diagram showing the directional flow of the exhaust air currents S3 and the removal of gaseous by-product 90 through the exhaust air passageways 114 is shown. Since the fog-producing gaseous by-product 90 is liberated from the thermally processable material 26 during development of an image in the thermally processable material 26, the fog-producing gaseous by-product 90 is mainly present within developing area 88. When the thermally processable material 26 is transported through the thermal processor 80 (indicated by directional arrow 202) with the emulsion side down, the fog-producing gaseous by-product 90 is mainly present within fog region A and fog region B (indicated in FIG. 7).

In a preferred embodiment, air is exhausted at a velocity along the surface of the thermally processable material 26 sufficient to exhaust the fog-producing gaseous by-product 90 before any fog is produced on the thermally processable material 26. Air adjacent the thermally processable material is exchanged, with the exhausted air continuously being replaced by fresh makeup air having a temperature which is approximate the temperature of the thermally processable material 26. Since the air moving across the surface of the thermally processable material 26 is heated to a temperature which is approximate the temperature of the thermally processable material 26, the development of the thermally processable material 26 is not affected by the air movements. Further, since the air movements are restricted to passage along the surface of the thermally processable material 26 in region A and region B only, other processes within the thermal processor 80 are not affected by air movement.

In one preferred embodiment shown, air is drawn along the bottom surface of the thermally processable material 26 and evacuated near the center region of the lower heated member 104. Further, air is evacuated within both fog region A and fog region B. It is also recognized that other patterns may be used for creating air currents along the emulsion surface of the thermally processable material 26 during development of an image in the material, and subsequent evacuation of the fog-producing gaseous by-product while remaining with the scope of the present invention.

It is recognized that the present invention may also be used for removing fog-producing gaseous by-product 90 from the oven 12 while thermally processable material is being processed within the thermal processor 80 with the emulsion side up. With this method of operation, it has been found that it may be necessary or at least preferred to add additional openings along the center area of gasket seal 200 (shown in FIG. 14). It is also recognized that the fog-producing gaseous by-product may be evacuated from the top of thermal processor 80, through the use of an exhaust fan located on the top of the thermal processor 80 or by using a fan to push the air through the thermal processor 80. It is also recognized that the makeup air S4 may be preheated to a desired temperature before it enters the oven 12, to further aid in increasing the temperature of the makeup air S4 to a temperature which is approximate the temperature of the thermally processable material 26.

Figure 16:
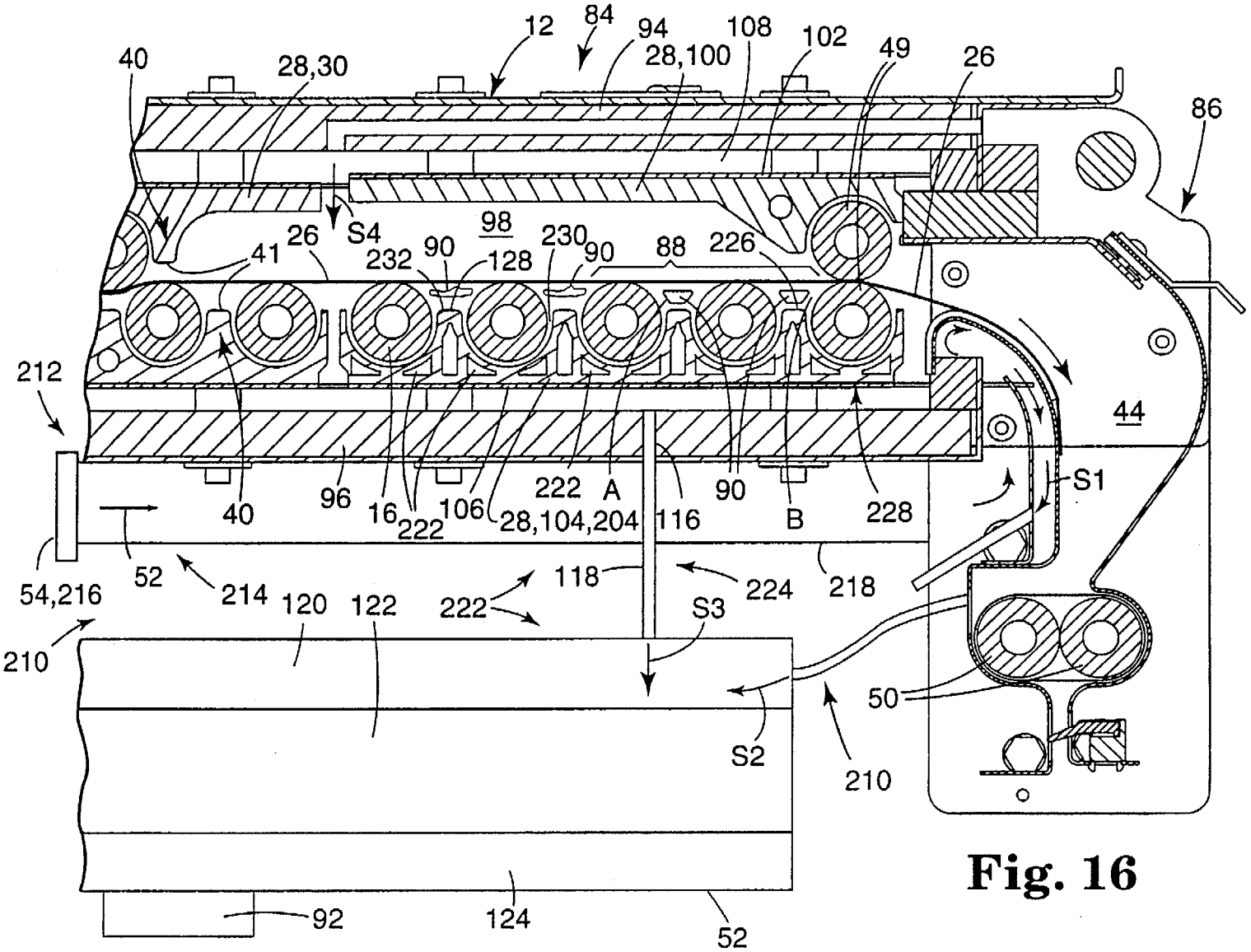
FIG. 16 is an enlarged partial side sectional view of another embodiment of a thermal processor having a fog reducing/eliminating system in accordance with the present invention.

Referring to FIG. 16, another embodiment of a thermal processor having a fog reducing system and method in accordance with the present invention is generally shown. Based on the chemical makeup of the thermally processable material 26, the amount of gaseous by-product 90 emitted or outgassed during development of the images on the thermally processable material may vary. Based on the amount of fog producing gaseous by-product 90 emitted by the thermally processable material 26 during the development process, it may be desirable or necessary to provide a fog reducing system which is able to evacuate substantial amounts of fog producing gaseous by-product 90 without harming or affecting the development of the image on the thermally processable material 26. Although it is recognized that one method of exhausting substantially amounts of gaseous by-products is to increase the volume of air moved across the surface of the film, simply increasing the volume of air may affect development of the image in the film. As such, the present invention provides a fog reduction system which uniformly moves a volume of air across immediately adjacent the surface of the thermally processing material, thereby evacuating a substantial increased amount of gaseous by-product while maintaining image quality.

As shown in FIG. 16, the fog reducing system 210 in accordance with the present invention provides a system and method of exhausting the fog producing gaseous by-product 90 from a location immediately adjacent the surface of the thermally processable material 26 (shown emulsion side down), including exhaust passageways through lower heated member or dwell plate 204 (which can be similar to lower member 204 previously described herein), and provides a passageway through the lower heated member or dwell plate 204 for fresh makeup air to replace the evacuated fog producing gaseous by-product 90 at the surface of the thermally processable material 26. Further, the makeup air is heated to the proximate temperature of the thermally processable material 26 such that it will not affect the development of images thereon. Additionally, the unique fog reducing system 210 provides a uniform air exchange system across the surface of the thermally processable material 26 such that image quality may be maintained.

In the exemplary embodiment shown, the fog reducing system 210 includes fresh makeup air system 212, which provides fresh makeup air to the surface of the thermally processable material 26. In one application, the fresh makeup air system 212 includes fresh makeup air supply mechanism 214 having a supply fan 216, an air duct 218, and makeup air passageways 220 extending through the lower member 204. Supply fan 216 can be similar to supply cooling fan 54, previously described herein. Makeup air duct 218 can also be in fluid communication with cooling section 86. As such, supply fan 216 may also provide cooling air stream S1 to cooling section 86. Alternatively, a separate supply fan 216 may be provided for providing makeup air for the fresh makeup air system 212 through the makeup air duct 218. Makeup air passageways 220 are in fluid communication with fresh makeup air supply mechanism 214 for uniformally providing makeup air at a location adjacent the thermally processable material 26. Further, as the makeup air passes through the makeup air passageways 220, the makeup air heats to a temperature which is approximately the temperature of the lower member 104, and as such, does not affect the development of an image on the thermally processable material 26.

The fog reducing system 210 further includes an exhaust system 222 for evacuating or exhausting the gaseous by-product 90 from the dwell section 84 before the fog producing gaseous by-product damages or "fogs" the thermally processable material 26. Exhaust system 222 may include exhaust passageways 224 extending through lower member 204, which are in fluid communication with exhaust tubular member 118, filter system 52, and exhaust fan 92 as previously described herein.

Heated lower member 204 includes a first major surface 226 and a second major surface 228. The first major surface 226 includes curved portions 230 and fin portions 232. Rollers 16 nest within curved portions 230. Curved portions 230 can be similar to curved region 130 as previously described herein. Fin portions 232 extend between curved portions 230, and can be similar to fins 126 as previously described herein.

Figure 17:
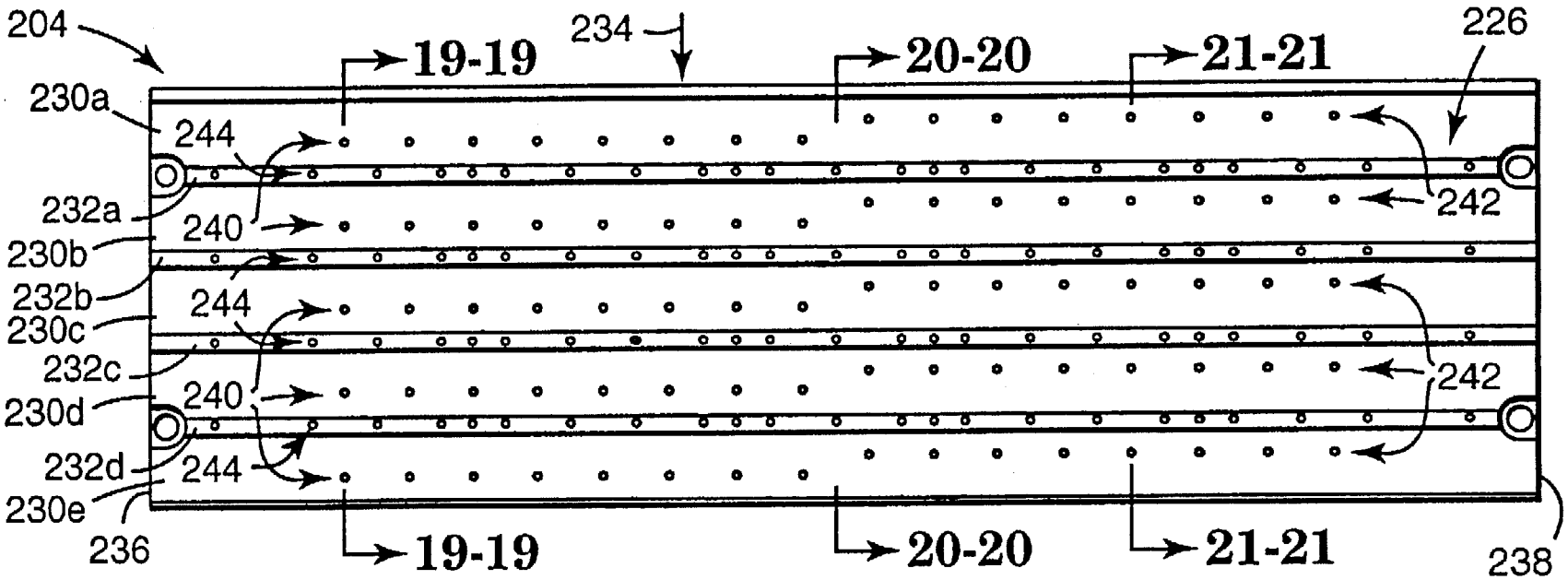
FIG. 17 is a top view of one exemplary embodiment of a lower member shown in FIG. 16.

Referring to FIG. 17, a top view of lower member 204 is shown. The plurality of curved portions 230 are indicated as 230*a*, 230*b*, 230*c*, 230*d* and 230*e*. Similarly, fin portions 232 are indicated as 232*a*, 232*b*, 232*c*, and 232*d*. Two adjacent curved portions 230 mate to form a fin portion 232. For example, curved portions 230*a* and 230*b* meet to form fin portion 232*a*; curved portions 230*b* and 230*c* meet to form fin portion 232*b*; curved portions 230*c* and 230*d* meet to form fin portion 232*c*; and curved portions 230*d* and 230*e* meet to form fin portion 232*d*.

Lower member 204 is generally rectangular shaped, and curved portions 230*a, b, c, d*, and *e* and fin portions 232*a, b, c*, and *d* extend longitudinally (and generally parallel to each other) across the lower member 204 in a direction which is generally perpendicular to the direction of movement of the thermal processable material 26, indicated by directional arrow 234. Lower member 204 includes a first end 236 and a second end 238. Each curved portion 230*a, b, c, d* and *e* includes a plurality of first makeup air ports 240 and a plurality of second makeup air ports 242. The first makeup air ports 240 are located proximate the first end 236, and the second makeup air ports 242 are located proximate the second end 238. The first makeup air ports 240 and the second makeup air ports 242 are spaced across the lower member 204 such that they cover the entire imaging region of the thermally processable material 26 as it passes over the lower member 204. Similarly, fin portions 232*a, b, c, d*, and *e* include exhaust air ports 244 extending through first major surface 226, spaced apart and extending across the lower member 204.

Figure 18:
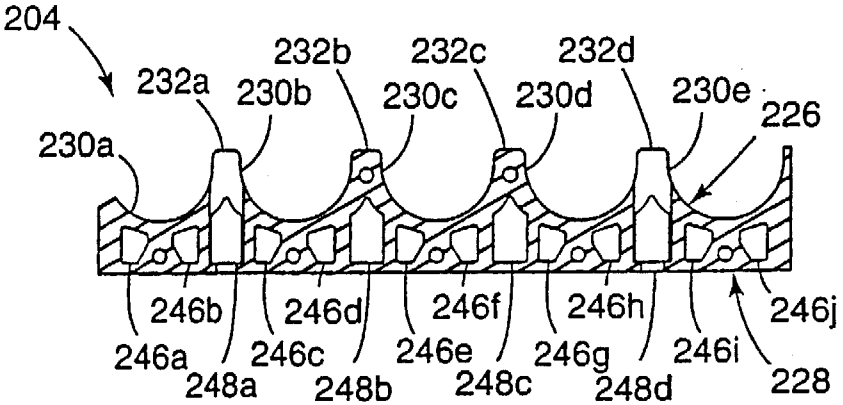
FIG. 18 is an end view of the lower member shown in FIG. 17.

Referring to FIG. 18, an end view of lower member 204 is shown. As shown, lower member 204 includes a plurality of makeup air chambers 246, indicated as 246*a, b, c, d, e, f, g, h, i*, and *j*. Each makeup air chamber 246*a, b, c, d, e, f, g, h, i*, and *j* extends longitudinally across the lower member 204 in a direction generally perpendicular to the direction of movement 234 of the thermally processable material 26, and are positioned adjacent a corresponding curved portion 230*a, b, c, d*, and *e* (for example, makeup air chambers 246*a* and 246*b* are positioned adjacent curved region 230*a*). The lower member 204 further includes exhaust air chambers 248 extending therethrough, indicated as exhaust air chambers 248*a, b, c*, and *d*. Each exhaust air chamber 248*a, b, c*, and *d* extend longitudinally across the lower member 204 in a direction which is generally perpendicular to the direction of movement 234 of the thermally processable material 26, and is positioned adjacent a corresponding fin portion 232*a, b, c*, and *d* (for example, exhaust air chamber 248*a* is positioned adjacent fin portion 232*a*).

Figure 19:
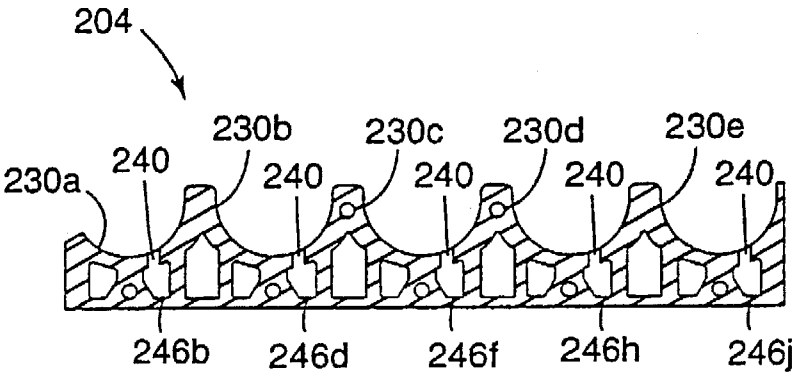
FIG. 19 is an enlarged cross-sectional view taken along line 19—19 of FIG. 17.

Referring to FIG. 19, an enlarged cross-sectional view of lower member 204 taken along line 19—19 of FIG. 17 is shown. As shown, first makeup air ports 240 extend through the corresponding curved portions 230*a, b, c, d*, and *e* of first major surface 226, and are in fluid communication with corresponding exhaust air chambers 246*b, d, f, h*, and *j*. Other element labels have not been shown for clarity.

Figure 20:
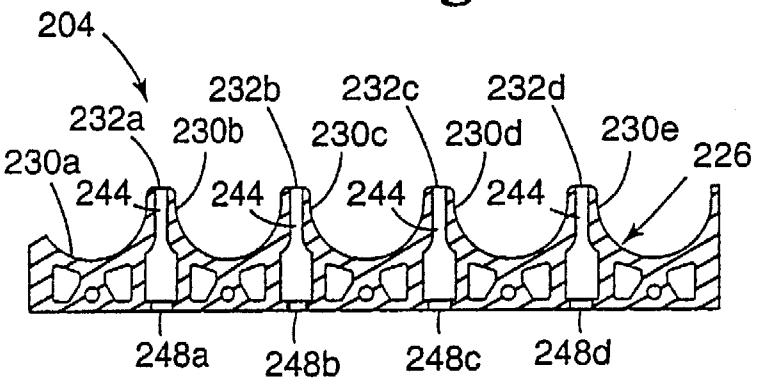
FIG. 20 is an enlarged cross-sectional view taken along line 20—20 of FIG. 17.

Referring to FIG. 20, an enlarged cross-sectional view of lower member 204 is shown taken along line 20—20 of FIG. 17. As shown in FIG. 20, exhaust air ports 244 extend through the corresponding fin portions 232*a, b, c*, and *d* of first major surface 226, and are in fluid communication with corresponding exhaust air chambers 248*a, b, c*, and *d*. The labeling of other elements have not been shown for clarity.

Figure 21:
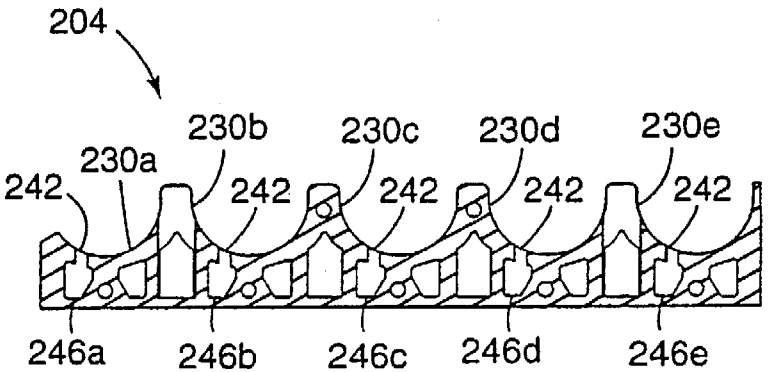
FIG. 21 is an enlarged cross-sectional view taken along line 21—21 of FIG. 17.

Referring to FIG. 21, second makeup air ports 242 are shown extending through corresponding curved portions 230*a, b, c, d*, and *e*, and are in fluid communication with corresponding makeup air chambers 246*a, c, e, g*, and *i*. Other element labels have not been shown in FIG. 21 for clarity.

Figure 22:
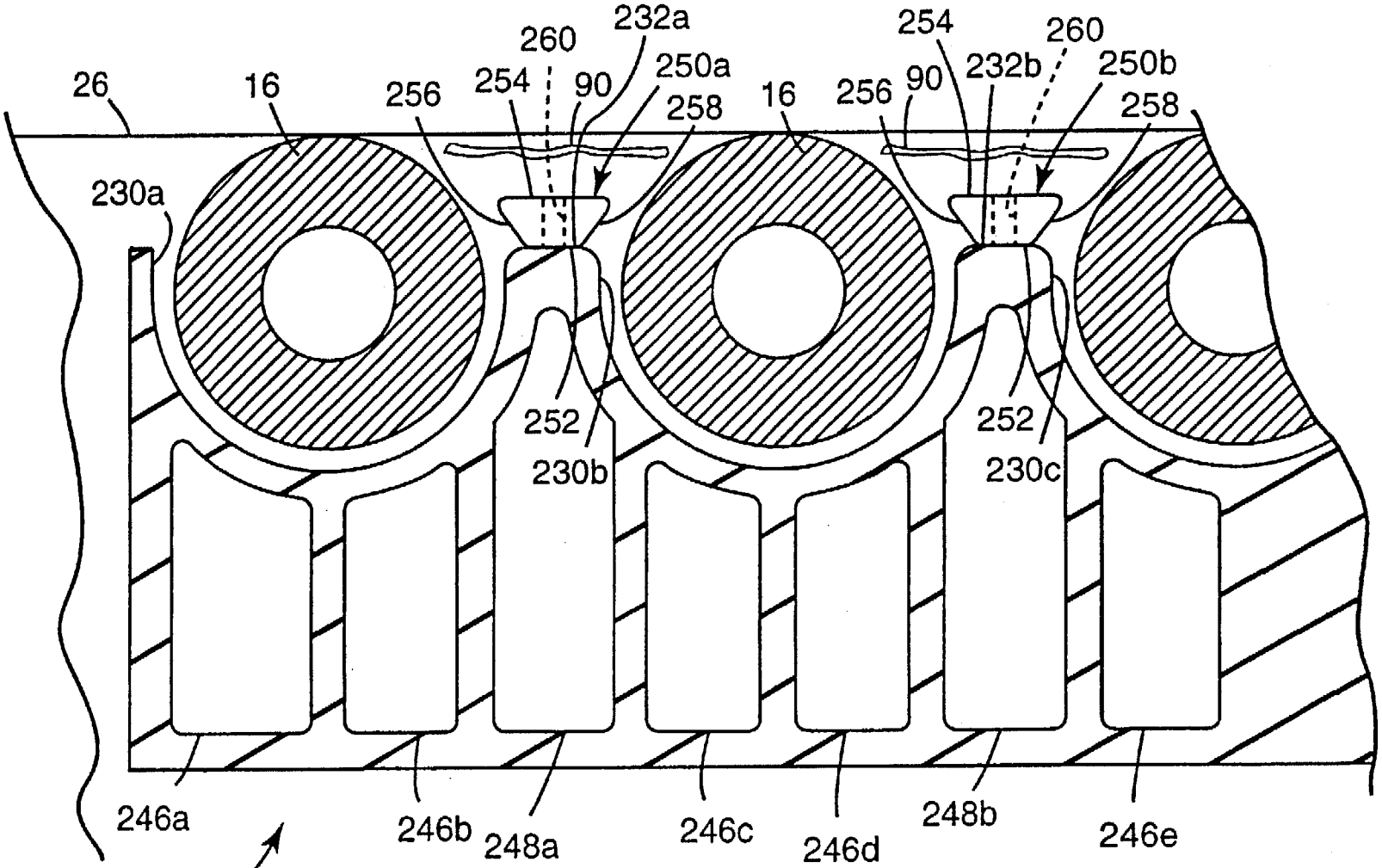
FIG. 22 is an enlarged partial cross-sectional view illustrating another embodiment of a lower member in accordance with the present invention.

Referring to FIG. 22, a partial side view illustrating one embodiment of the thermal processor in accordance with the present invention is generally shown. As shown in FIG. 22, lower member 24 may further include fin extension members 250, indicated 250*a* and 250*b*. In one preferred embodiment, fin extension members 250*a* and 250*b* extend longitudinally along the top of corresponding fin portions 232*a* and 232*b*. The fin extension members 250*a* and 250*b* are generally trapezoidal shaped, and include a first major surface 252, a second major surface 254, a first side 256 and a second side 258. The fin extension members are coupled to the corresponding fin portions at first major surface 252 (e.g., by a bolted connection). Second major surface 254 is wider than first major surface 252 and is positioned adjacent the thermally processable material 26 and fog producing gaseous by-product 90. Further, fin extension members 250*a* and 250*b* include a plurality of openings 260 passing therethrough which communicate with the corresponding exhaust air ports 244 for exhaust air chambers 248*a*, 248*b*. Fin extension members 250 allow the exhaust passageways 244 to have an opening immediately adjacent the thermally processable material 26 and corresponding fog producing by-product 90 for immediate evacuation of the fog producing gaseous by-product 90 away from the surface of the thermally processable material 26 before the gaseous by-product 90 fogs the image developed on the material 26. The unique trapezoidal shape of fin extension members 250 decreases the presence of stagnant air pockets along the surface of the thermally processable material which may include gaseous by-product 90, and increases the velocity of the movement of makeup air across the surface of the thermally processable material. The trapezoidal shape minimizes the volume of air present, such that less air is required to replace the smaller air volume. As such, the flow rate of air moved through the fog reduction system can be reduced, allowing the makeup air stream to more easily reach the approximate temperature of the material 26. Further, in one preferred embodiment shown, the unique trapezoidal shape of the fin extension member provides a fin extension member which minimizes the chances of machine jams due to an edge of the thermally processable material 26 jamming or catching on the fin extension member, since the wider first major surface reduces the gap between the fin and the roller, and providing surface for the material 26 to slide across, thereby allowing the top of the fin portion to be positioned closer to material 26. Additionally, fin extension members 250 provide an extended path for makeup air, allowing the makeup air to reach a temperature which is approximately the temperature of the thermally processable material 26.

Figure 23:
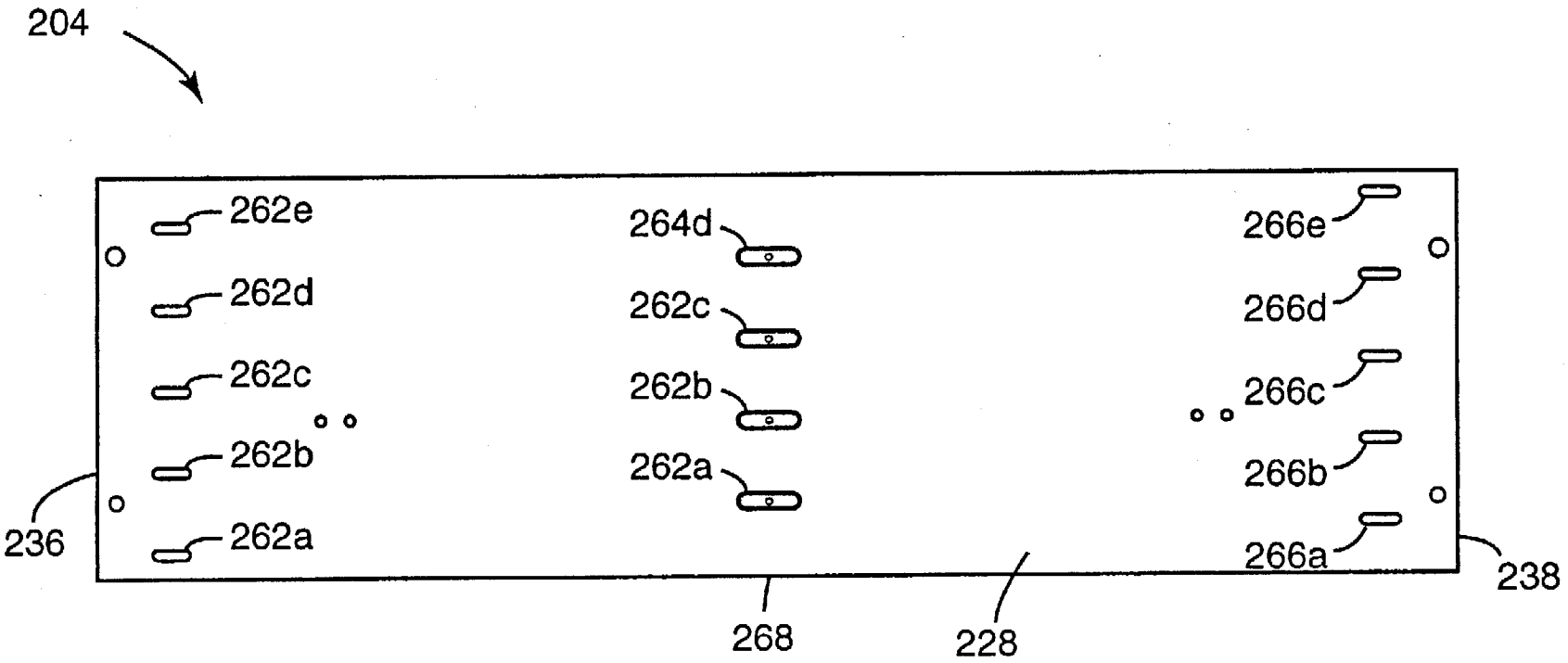
FIG. 23 is a bottom view illustrating an exemplary embodiment of a lower member in accordance with the present invention.

Referring to FIG. 23, a bottom view of lower member 204 is shown. Second major surface 228 includes makeup air openings 262*a, b, c, d*, and *e*, exhaust openings 264*a, b, c* and *d*, and makeup air openings 266*a, b, c, d*, and *e*. Makeup air openings 262*a, b, c, d*, and *e* are located proximate first end 236, exhaust openings 264*a, b, c* and *d* is located proximate central portion 268, and makeup air openings 266*a, b, c, d*, and *e* are located proximate second end 238. Makeup air openings 262, 266 extend into the corresponding makeup air chambers 246, and exhaust air openings 264 extend into corresponding exhaust air chambers 248. In the exemplary embodiment shown, opening 262*a* extends into chamber 246*a*, opening 262*b* extends into chamber 246*c*, opening 262*c* extends into chamber 246*e*, opening 262*d* extends into chamber 246*g*, and opening 262*e* extends into chamber 246*i*. Opening 264*a* extends into exhaust chamber 248*a*, opening 264*b* extends into exhaust chamber 248*b*, opening 264*c* extends into exhaust chamber 248*c*, and opening 264*d* extends into exhaust chamber 248*d*. Opening 266*a* extends into chamber 246*b*, opening 266*b* extends into chamber 246*d*, opening 266*c* extends into chamber 246*f*, opening 266*d* extends into chamber 246*h*, and opening 266*e* extends into chamber 246*j*. Further, the openings 262*a, b, c, d* and *e*, openings 264*a, b, c* and *d*, and openings 266 *a, b, c, d*, and *e* extend through heating blanket 106.

Figure 24:
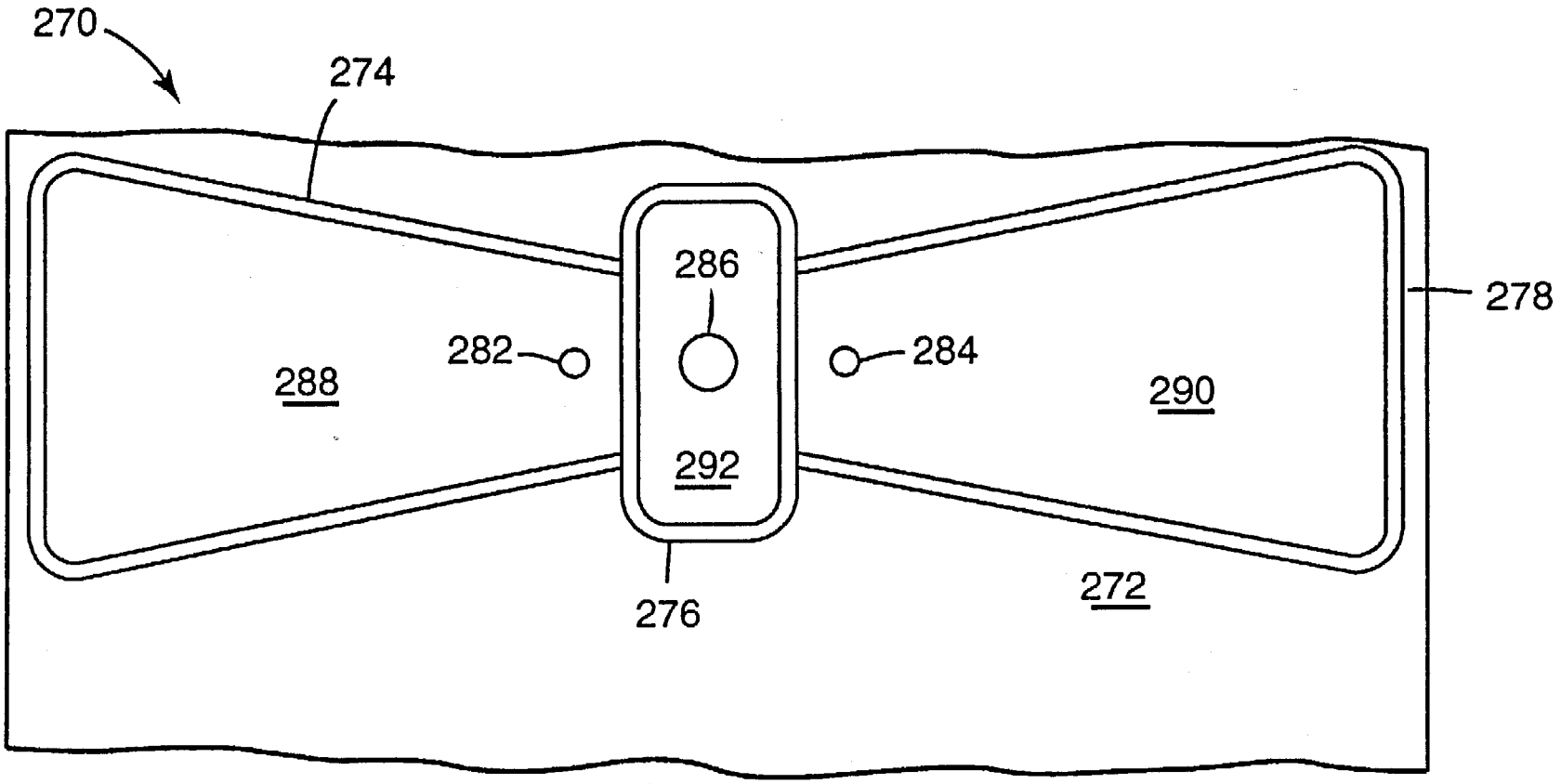
FIG. 24 is a plan view illustrating an exemplary embodiment of a coupling/sealing member for use with the thermal processor having a fog reduction system in accordance with the present invention.

Referring to FIG. 24, a partial top view of one exemplary embodiment of an air passage sealing assembly is generally shown. The air passage sealing assembly 270 includes base member 272, first gasket seal 274, second gasket seal 276, third gasket seal 278, first makeup air conduit 282, second makeup air conduit 284, and exhaust air conduit 286. The air passage sealing assembly 270, and in particular, first gasket seals 274, second gasket seal 276, and third gasket seal 278 seal the air passage sealing assembly 270 against the lower blanket heater 106 coupled to second major surface 228. First makeup air conduit 282 and second makeup air conduit 284 are in fluid communication with makeup air duct 218. Similarly, exhaust air conduit 286 is in fluid communication with tubular member 118. As such, when air passage sealing assembly is sealed against the lower member 204, and lower blanket heat 106, first makeup air conduit 282 provides an air passageway for makeup air from makeup air passageway 220 through region 288 and through corresponding openings 262*a, b, c, d* and *e*. Similarly, second makeup air conduit 284 provides a passageway from makeup air duct 218 through region 290, through makeup air openings 266*a, b, c, d*, and *e*. Exhaust air conduit 286 provides an exhaust air passageway between tubular member 118, region 292 and exhaust air openings 264*a, b, c*, and *d*.

Figure 25:
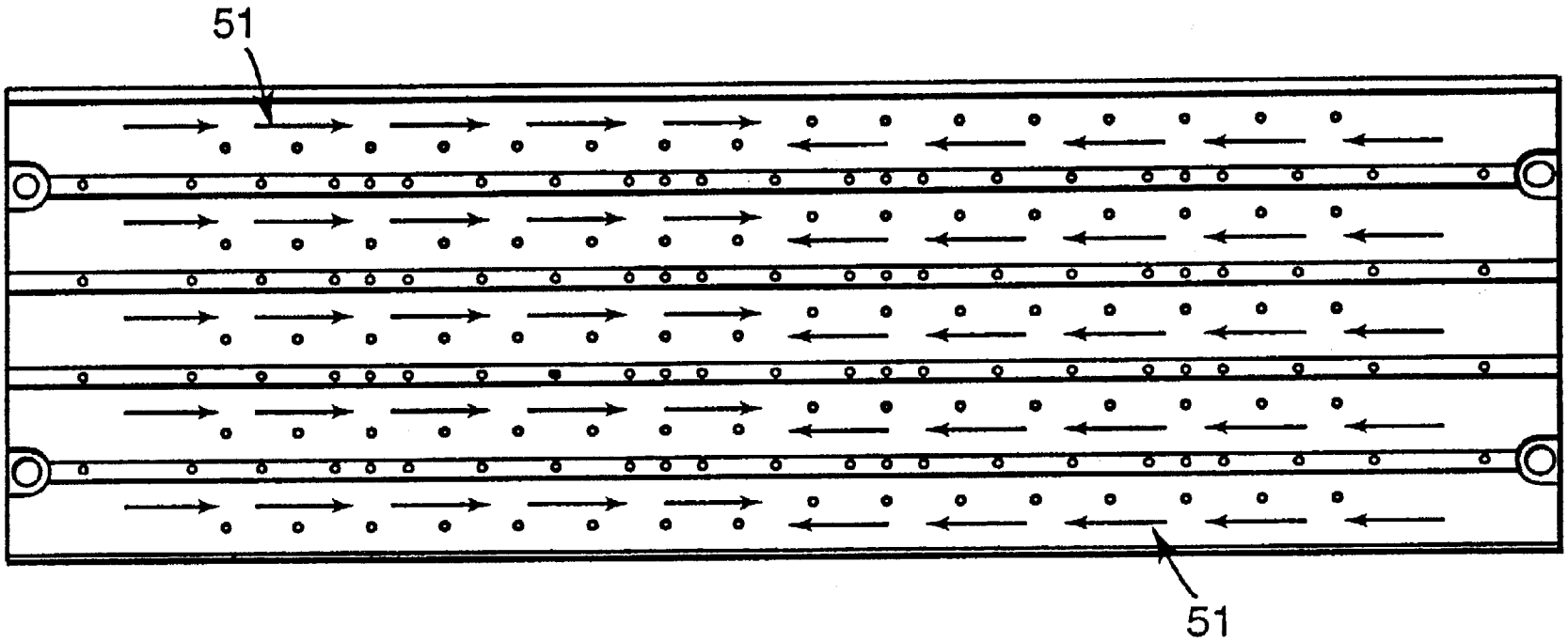
FIG. 25 is a diagram illustrating air flow through the lower member of a thermal processor fog reduction system in accordance with the present invention.

Referring to FIG. 25 (and the previous figures described herein), an air flow diagram is shown illustrating makeup air and exhaust air flow through the thermal processor fog reducing system 210, including lower member 204. Referring also to FIG. 1, supply fan 216 provides fresh makeup air through makeup air passageway 220, through first makeup air conduit 282 and second makeup air conduit 284, through corresponding openings 262*a, b, c, d*, and *e*, and 266*a, b, c, d*, and *e*. As shown in FIG. 25, fresh makeup air, indicated by makeup air stream arrows S1 travels the length of lower member 104 through corresponding chambers 246*a, b, c, d, e, f, g, h, i* and *j*. As the makeup air S1 travels the length of the lower member 204 within the corresponding makeup air chambers 246, and exits the curved regions 230*a, b, c, d, e* at corresponding makeup air ports 240, 242, the air is heated to a temperature which is approximately the temperature of the lower member 204 and/or approximately the temperature of the thermally processable material 26.

Figure 26:
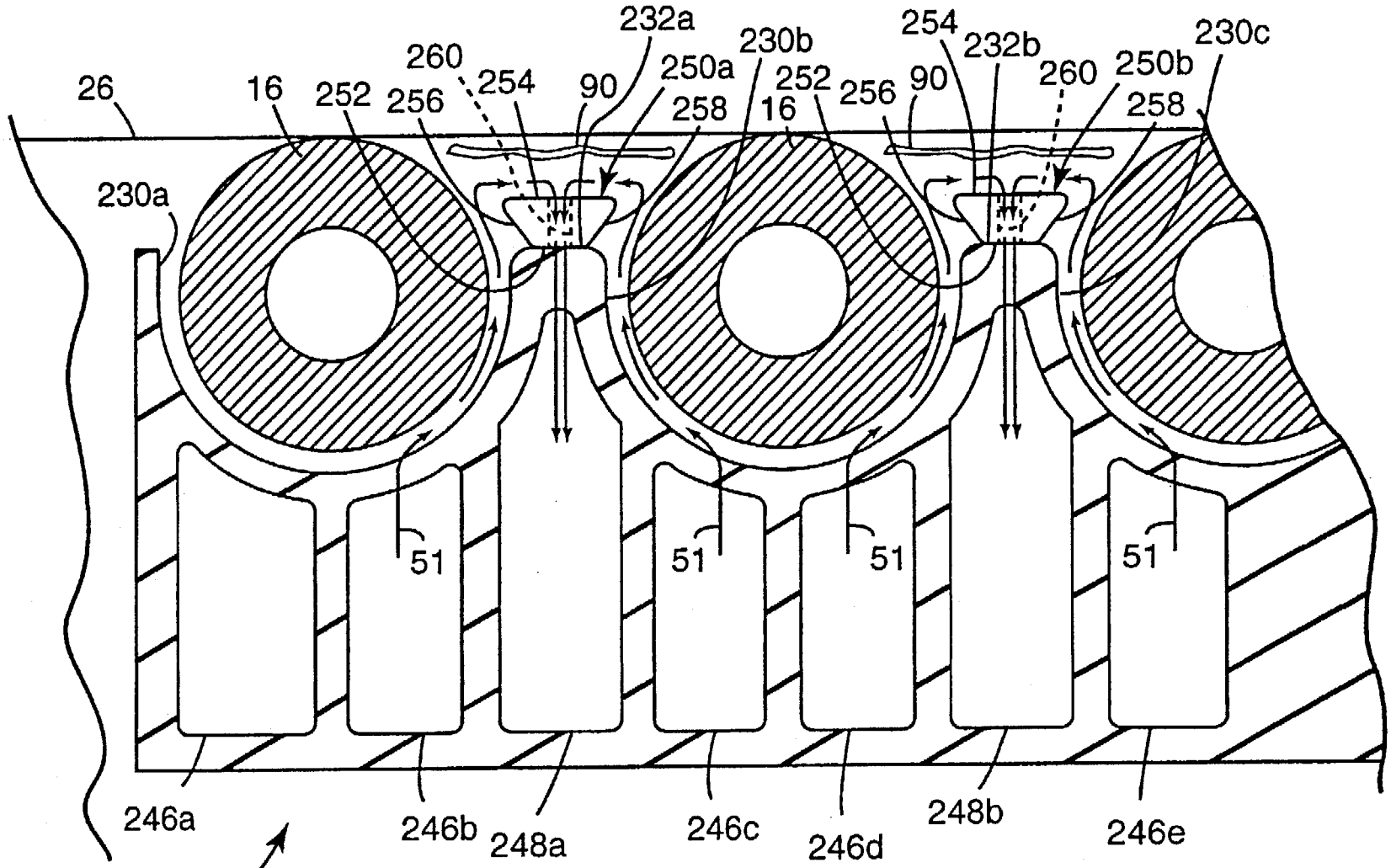
FIG. 26 is another diagram illustrating air flow through the thermal processor having a fog reduction system in accordance with the present invention.

Referring to FIG. 26, the fresh makeup air streams S1 continue to heat up as they move between the rollers 16 and the corresponding curved regions 230*a, b, c, d*, and *e*. The makeup air streams S1 follow a path past the fin extension members 250 (250*a* and 250*b* as shown) providing fresh makeup air adjacent the surface of the thermally processable material 26. Since the fresh makeup air streams S1 have been heated to a temperature which is approximate the temperature of the thermally processable material 26, the fresh makeup air streams S1 do not detrimentally affect the quality of the image developed on the thermally processable material 26. Simultaneously, exhaust air streams S3 laden with fog producing gaseous by-product 90 are uniformly pulled from the region immediately adjacent the surface of the thermally processable material 26, through the fin extension member openings 260, through fin portions 232, into the corresponding exhaust air chambers 248. As previously described herein, the exhaust air chambers 248 are in fluid communication with exhaust passageways 224, including tubular member 118 through air passage sealing assembly 270, for evacuation and removal of the exhaust air streams S3 from the thermal processing assembly. Further, as previously described herein, filter exhaust fan 92 creates a negative pressure for pulling the exhaust air stream S3 through filter 52 and exhaust fan 92 to exit the thermal processor.

Figure 27:
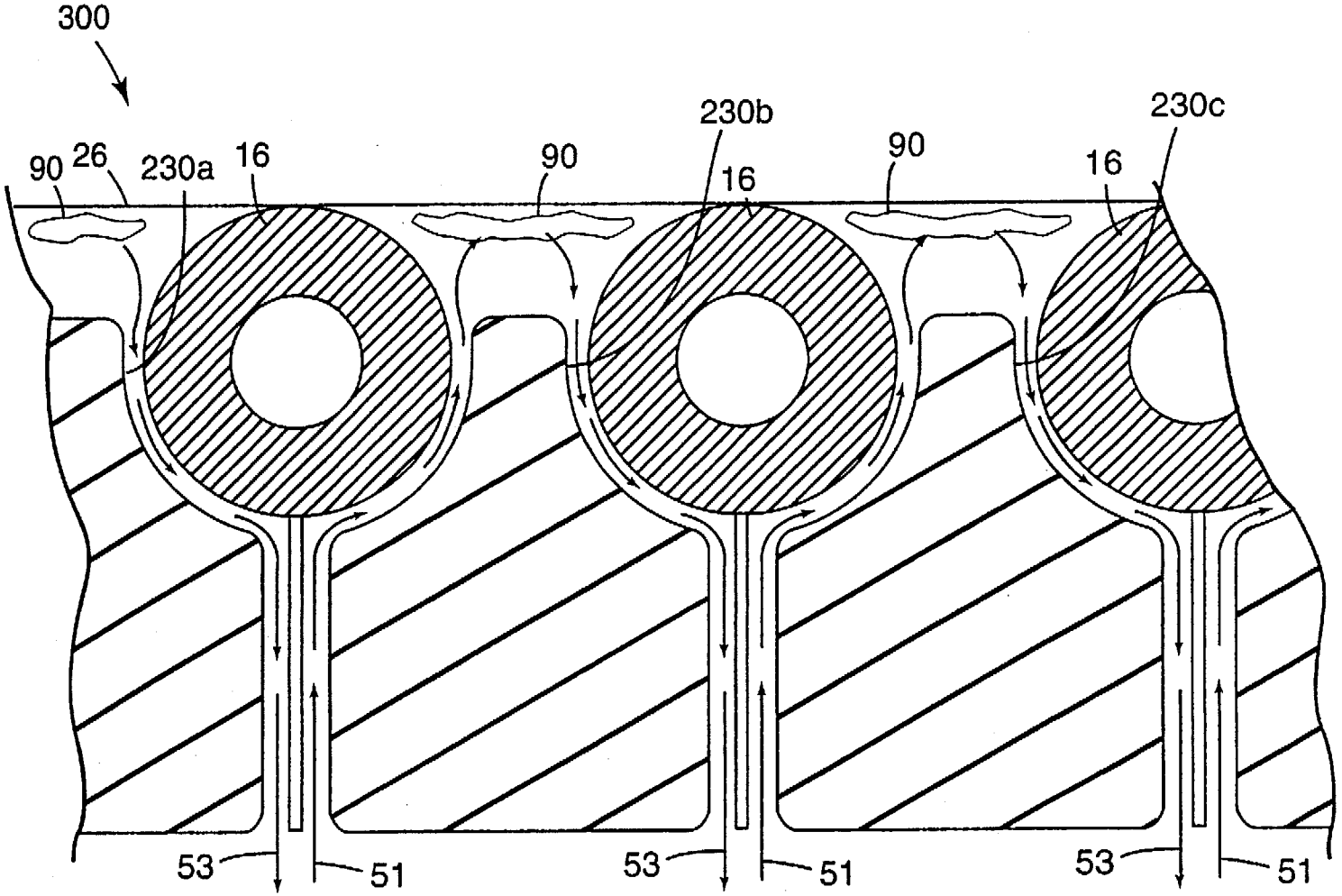
FIG. 27 is a partial cross-sectional view illustrating another alternative embodiment of a thermal processor having a fog reduction system in accordance with the present invention.

Referring to FIG. 27, yet another embodiment of a fog reducing system in accordance with the present invention is shown at 300. The fog reducing system 300 can be similar to the fog reducing system 210 previously described herein. Sealing members 302 are positioned adjacent rollers 16 within curved regions 230*a, b*, and *c*. As such, makeup air stream S1 passes through lower member 204 and follows a path between a corresponding roller 16 and curved portion 230*a*. The makeup air stream S1 exchanges the exhaust air stream S3, including the fog producing gaseous by-product 90, which exits following a path along adjacent curved portion 230*b* as shown. As such, both fresh makeup air streams S1 and exhaust air streams S3, separated by sealing members 302, pass through curved regions 230*a, b*, and *c*. It is also recognized that sealing members 302 may be removed, and makeup air stream S1 can be brought in at curved region 230*a*, and exhaust air streams S3 exit at an adjacent curved portion 230*b*.

It will be understood that the disclosed embodiments are, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. A thermal processor for use in developing an image in an imaging material which is transported along a transport path through the thermal processor, wherein as the image is developed in the imaging material a gaseous by-product is emitted from the imaging material which may tend to cause fogging of the developed image, the thermal processor comprising:

a preheat assembly for preheating the imaging material to a desired temperature;

a dwell assembly for thermal development of the imaging material;

a cooling assembly for cooling the imaging material after development; and a mechanism which moves the imaging material along the transport path through the preheat assembly, the dwell assembly, and the cooling assembly;

wherein the dwell assembly includes:

a heated lower member having a major surface facing the imaging material, a lower member makeup air passageway extending through the major surface, and a lower member exhaust air passageway extending through the major surface; and an exhaust mechanism in fluid communication with the lower member exhaust air passageway for removal of the gaseous by-product therethrough.

2. The processor of claim 1, further comprising an makeup air mechanism in fluid communication with the lower member make-up air passageway which provides make-up air through the lower member makeup air passageway.

3. The processor of claim 2, wherein the makeup air mechanism includes a fresh air supply fan.

4. The processor of claim 1, wherein the exhaust air mechanism includes an exhaust fan.

5. The processor of claim 1, wherein the exhaust air passageway extends longitudinally through the lower member in a direction generally perpendicular to the direction of movement of the film, and includes an exhaust port opening extending through the major surface.

6. The processor of claim 5, wherein the makeup air passageway extends longitudinally through the lower member in a direction generally perpendicular to the direction of movement of the film, and includes a makeup air port opening extending through the major surface.

7. The processor of claim 1, wherein the major surface includes a curved portion extending generally longitudinally across the lower portion in a direction generally perpendicular to direction of movement of the film, and a fin portion, wherein the mechanism which moves the imaging material includes a roller which nests within the curved portion, and wherein the imaging material includes an emulsion surface which contacts the surface of the roller.

8. The processor of claim 7, wherein the exhaust air passageway includes an exhaust air chamber extending longitudinally through the lower member in a direction generally perpendicular to the direction of movement of the film, having an exhaust port extending through the major surface; and wherein the make-up air passageway includes a makeup air chamber extending longitudinally through the lower member generally parallel to the exhaust air passageway, having a makeup air port extending through the major surface.

9. The processor of claim 8, wherein the exhaust air chamber is adjacent the fin portion and the makeup air chamber is adjacent the curved portion.

10. The processor of claim 9, wherein the exhaust air port extends through the fin portion and the makeup air port extends through the curved portion.

11. The processor of claim 8, further comprising a makeup air mechanism in fluid communication with the exhaust air passageway which provides fresh makeup air through the lower member exhaust air passageway, wherein the makeup air chamber includes a first end and a second end, and wherein the makeup air mechanism is coupled to the exhaust air passageway proximate the first end, and wherein the makeup air port is in fluid communication with the makeup air chamber proximate the second end, allowing the makeup air to be heated to a temperature which is approximate the temperature of the lower member.

12. The processor of claim 7, further wherein the fin portion is generally trapezoidal shaped, having its widest major surface adjacent the imaging material.

13. The processor of claim 7, further comprising a fin extension member extending longitudinally along the fin portion, wherein the fin extension member is generally trapezoidal shaped, having a first major surface a second major surface wider than the first major surface, wherein the second major surface is positioned adjacent the imaging material.

14. A thermal processor for use in developing an image on a thermal photographic material which is transported along a transport path through the thermal processor, wherein as the image is developed in the thermal photographic material a gaseous by-product is emitted from the imaging material which may tend to cause fogging of the developed image, the thermal processor comprising:

a development chamber defined by a heated upper member and a heated lower member; and a mechanism for moving the thermal photographic material through the development chamber along the transport path, including a plurality of rollers movably mounted within the development chamber extending longitudinally across the development chamber in a direction generally perpendicular to the direction of movement of the thermal photographic material, wherein each roller includes a roller surface which contacts the thermal photographic material, wherein the heated lower member includes a first major surface and a second major surface, the first major surface including a plurality of curved portions and a plurality of fin portions, wherein each roller nests within a corresponding curved portion, and wherein each fin is defined by adjacent curved portions;

a fog reduction system for removal of the gaseous byproduct emitted from the thermal photographic material before it causes fogging including an exhaust air chamber extending longitudinally through the lower member having an exhaust port extending through the fin portion at a location adjacent the thermal photographic material, a makeup air chamber extending longitudinally through the lower member having a makeup air port extending through the curved portion adjacent a roller; and a makeup air mechanism in fluid communication with the makeup air chamber which provides fresh makeup air through the makeup air port.

15. The thermal processor of claim 14, wherein the makeup air chamber extends longitudinally through the lower member in a direction generally perpendicular to the direction of movement of the thermal photographic material, the makeup air chamber including a first end and a second end, wherein the makeup air mechanism is in fluid communication with the makeup air chamber at a location proximate the first end, and wherein the makeup air port extends from the makeup air chamber at a location proximate the second end, allowing the makeup air to heat up to a temperature which is approximate the temperature of the lower member.

16. The thermal processor of claim 15, further comprising a second makeup air port extending from the makeup air chamber through the curved portion, located proximate the second end.

17. The thermal processor of claim 15, further comprising a second makeup air chamber extending through the lower member located adjacent the first makeup air chamber having a makeup air port extending through the curved portion and including a first end and a second end, wherein the makeup air port is in fluid communication with the second makeup air chamber at a location proximate the second end, and wherein the makeup air port extends from the second makeup chamber at a location proximate the first end.

18. The thermal processor of claim 17, wherein the first makeup air chamber first end is positioned adjacent the second makeup air chamber first end.

19. The thermal processor of claim 14, further comprising an exhaust mechanism in fluid communication with the exhaust air chamber for removal of the gaseous byproduct therethrough.

20. The thermal processor of claim 14, further wherein the fin portion is generally trapezoidal shaped, having its widest major surface adjacent the thermal photographic material.

21. The thermal processor of claim 14, further comprising a fin extension member extending longitudinally along the fin portion positioned adjacent the thermal photographic material.

22. The thermal processor of claim 21, wherein the fin extension member is generally trapezoidal shaped, having a first major surface and a second major surface wider than the first major surface, wherein the second major surface is positioned adjacent the thermal photographic material.

* * * * *